US007019276B2

(12) United States Patent
Cloutier et al.

(10) Patent No.: US 7,019,276 B2
(45) Date of Patent: Mar. 28, 2006

(54) DISTRIBUTED DIMMABLE LIGHTING CONTROL SYSTEM AND METHOD

(75) Inventors: Serge Cloutier, Montréal-Nord (CA); Gabriel-Adrian Strimbeanu, Laval (CA)

(73) Assignee: UTC Canada Corporation Micro Thermo Technologies Division, Laval (CA)

( * ) Notice: Subject to any disclaimer, the term of this patent is extended or adjusted under 35 U.S.C. 154(b) by 313 days.

(21) Appl. No.: 10/331,779

(22) Filed: Dec. 31, 2002

(65) Prior Publication Data

US 2004/0124338 A1 Jul. 1, 2004

(51) Int. Cl.
*H01J 40/14* (2006.01)

(52) U.S. Cl. ..... 250/214 AL; 250/214 D; 315/149; 315/159

(58) Field of Classification Search ..... 250/214 D, 250/214 AL, 214 B, 214 C, 214 L, 214 RC, 250/206, 203, 205; 315/149–151, 156–159, 315/291, 307, 308, DIG. 4
See application file for complete search history.

(56) References Cited

U.S. PATENT DOCUMENTS 5,648,656 A * 7/1997 Begemann et al. ... 250/214 AL
6,160,352 A * 12/2000 Steinel ..... 315/156
6,225,760 B1 * 5/2001 Moan ..... 315/360
6,307,331 B1 * 10/2001 Bonasia et al. ..... 315/294

OTHER PUBLICATIONS

"Introduction to the LonWorks System", Echelon Corporation, 1999, Palo Alto, CA, http://osa.echelon.com/Program/PDFs/IntroLonWorksSystem.pdf.

* cited by examiner

*Primary Examiner*—David Porta
*Assistant Examiner*—Suezu Ellis
(74) *Attorney, Agent, or Firm*—Ogilvy Renault LLP; Isabelle Chabot

(57) ABSTRACT

To reduce energy costs in buildings where there is an input of natural light, a method of maintaining an ambient light intensity in a building area at a predetermined level is proposed. It comprises obtaining an ambient light intensity level for the building area; comparing the ambient level to the predetermined level of light intensity; if the ambient level differs from the predetermined level, calculating an artificial lighting input to be generated in the building area to attain the predetermined level. It can further comprise generating the artificial lighting input in the building area and carrying out the steps of obtaining, comparing and calculating a second time to determine a quality of the calculating and modify the generating.

14 Claims, 26 Drawing Sheets

Dimmer 1 PID Settings

| | | |
|---|---|---|
| Ctrl Mode | Proportional | |
| Proportional Band (Pb) | 250.0 | Lux |
| Null | 0 | % |
| Gap | 1.0 | % |
| Direct/Reverse | Direct | |
| Ramp Timer | 5 | s |

PID Input/Output

| | | |
|---|---|---|
| Measured | 331 | Lux |
| Set Point (Actual) | 0 | Lux |
| PID Output | 0.0 | % |

✓ OK  × Cancel

FIG. 13

Limits – Dimmer 1

Start / Stop Limitations

Lamp Preheat Time 10 m 0 s

Lamps Cooling Time 15 m 0 s

Start Lighting Automatically

If Under 640 Lux

For 10 m 0 s

Stop Lighting Automatically

If Above 750 Lux

For 10 m 0 s

✓ OK × Cancel

FIG. 14

DISTRIBUTED DIMMABLE LIGHTING CONTROL SYSTEM AND METHOD

FIELD OF THE INVENTION

The invention relates to controlling lighting in buildings. More specifically, it relates to controlling the intensity of artificial lighting in buildings where there is an input of natural lighting.

BACKGROUND OF THE INVENTION

Lighting stores and commercial buildings is a considerable expense to building owners. Typically, a lighting architecture is designed when the building is built and the lights are either turned on or off by the store manager during operating hours. Most lights are grouped into sections which are turned on or off as a whole. Some lights may have dimmers which allow a store manager to vary the intensity of groups of lights or individual lights.

Some store owners use timers to turn on and off lights, individually or collectively, especially in cases where the lamps need a warm-up delay before turning on completely and a cooling delay when turning off.

Most stores have large windows on at least one side of the building. Some also have atrium windows and light wells or window wells which allow natural light to penetrate the building and illuminate the merchandise.

The light intensity is evaluated subjectively by the store manager and is typically not adjusted even in days of great sunshine. Lights remain turned on near the windows as if there was no natural input.

There is a need to better control the input of artificial lighting in building where there is an input of natural lighting to save on energy costs.

Furthermore, relamping burnt lamps is very expensive and when a lamp is used constantly, it burns faster. There is also a need to increase the relamping period in commercial buildings.

SUMMARY OF THE INVENTION

Accordingly, an object of the present invention is to maintain ambient light level of a building area to a user specified level by varying the artificial lighting source according to natural lighting contribution coming from the windows and skylight of the building.

A further object of the present invention is to reduce the light contribution from an artificial lighting system proportionally to the natural lighting supply to lower the energy costs while maintaining the proper light level dictated by the user.

Another object of the present invention is to use a minimum of artificial lighting to satisfy a user's requirements by at least one of turning off lamps and dimming a light intensity of a dimmable lamp to an acceptable minimum.

Still another object of the present invention is to log data on the natural lighting contribution and the artificial lighting contribution to produce control reports to better adapt the control system to the conditions of the building.

Another object of the present invention is to allow a live configuration of the control system to ensure proper lighting at all times.

Another object of the present invention is to reduce costs by extending periods between relamping.

According to a first broad aspect of the present invention, there is provided a method for maintaining an ambient light intensity in a building area at a predetermined level is proposed. It comprises obtaining an ambient light intensity level for the building area; comparing the ambient level to the predetermined level of light intensity; if the ambient level differs from the predetermined level, calculating an artificial lighting input to be generated in the building area to attain the predetermined level.

Preferably, the method further comprises generating the artificial lighting input in the building area and carrying out the steps of obtaining, comparing and calculating a second time to determine a quality of the calculating and modify the generating.

According to a second broad aspect of the present invention, there is provided a system for maintaining an ambient light intensity in a building area at a predetermined level. The system comprises at least one light level sensor to obtain an ambient light intensity level for the building area; a light intensity verifier for comparing the ambient level to the predetermined level of light intensity; and a light intensity controller for calculating an artificial lighting input to be generated in the building area to attain the predetermined level, if the ambient level differs from the predetermined level.

Preferably, the system further comprises at least one artificial lamp in the building area to generate the artificial lighting input in the building area.

BRIEF DESCRIPTION OF THE DRAWINGS

These and other features, aspects and advantages of the present invention will become better understood with regard to the following description and accompanying drawings wherein:

FIG. 1A, FIG. 1B and FIG. 1C are graphical representations of the prior art lighting systems, wherein FIG. 1A is a lamp with a ballast, FIG. 1B is a lamp controlled by a relay board and FIG. 1C is a lamp for which operation is controlled by a scheduler;

FIG. 12 is a graphical illustration of the interface of the control system showing the dimmer settings for the control system;

FIG. 13 is a graphical illustration of the interface of the control system showing the PID settings for the dimmers;

FIG. 14 is a graphical illustration of the interface of the control system showing the limits settings for the dimmers;

DETAILED DESCRIPTION OF THE PREFERRED EMBODIMENT

Figure 1A:
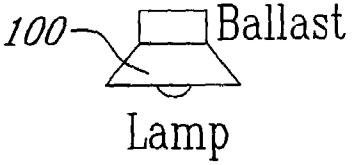
FIG. 1A PRIOR ART
Figure 1B:
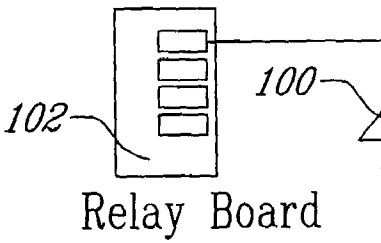
FIG. 1B PRIOR ART
Figure 1C:
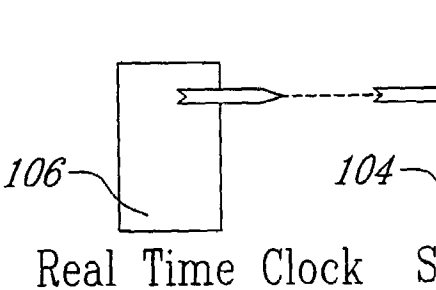
FIG. 1C PRIOR ART

As shown in FIG. 1, a zone, or building area, is equipped with at least one lamp 100 to light it. Examples of these lamps can be controllable electronic HID Ballast lamps available from Delta Power Supply Inc of Cincinnati, Ohio.

As shown in FIG. 2, power is applied to the lamp(s) 100 of the zone by energizing a relay mounted in a Lighting Control Panel or Relay Board 102. To turn the light ON, the attendant responsible for this zone must energize the associated relay otherwise the light will be OFF in this zone.

Normally, the requested state of the light 100 in a zone is controlled according to a schedule specifying at what time the light must be turned OFF or ON. This is done by connecting a scheduler 104 to the Relay Board 102. The scheduler 104 uses a real time clock 106 to ensure proper operation.

The embodiment of the invention discussed herein uses distributed control technology where instrumentation and control devices can be seen as nodes on a network where information is exchanged on a common medium with standard protocols. Therefore, the basic non-dimming lighting control system is composed of a Real Time Clock node 106, a Scheduler node 104, a Relay node 102 and all light ballast and lamps 100. Preferably, a LonWorks network is used. The LonWorks network is based on the LonWorks protocol also known as ANSI/EIA 709.1 Control Networking Standard.

Figure 2A:
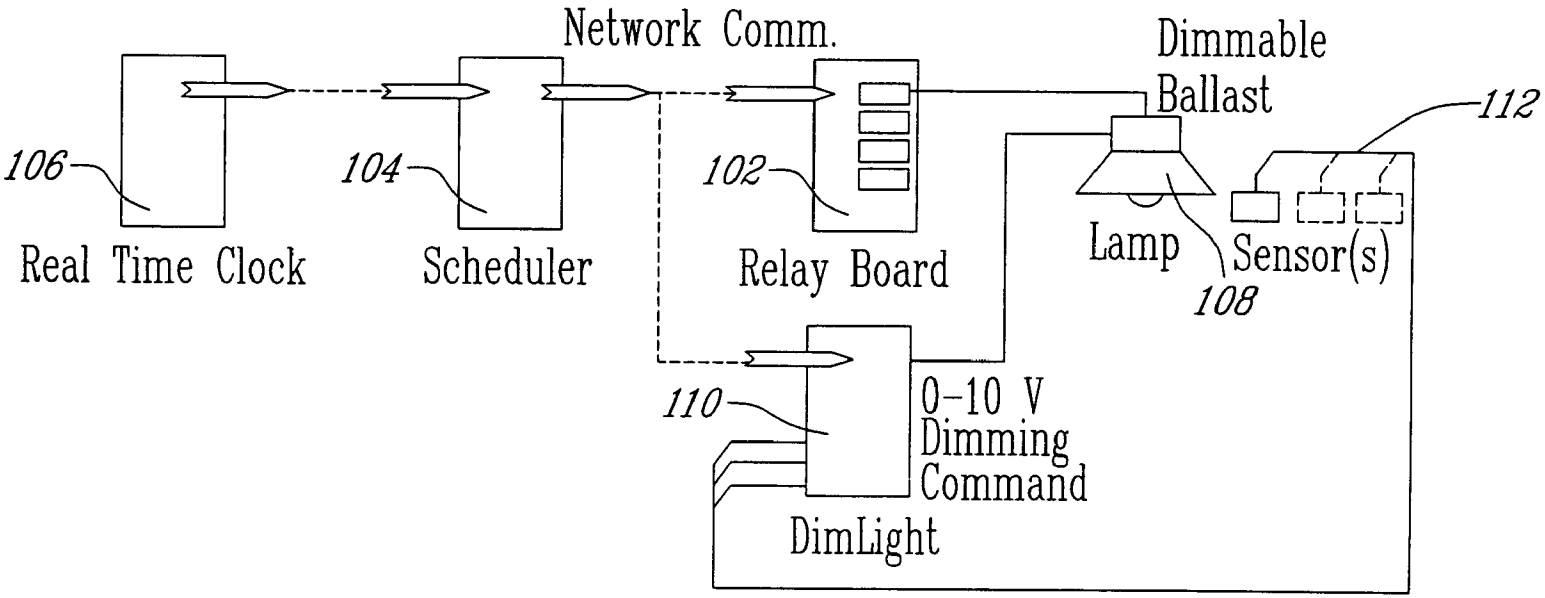
FIG. 2A and FIG. 2B are graphical representations of embodiments of the present invention, in FIG. 2A, only one lamp is controlled by the lighting control system, in FIG. 2B, groups of lamps are controlled by the control system.

The schedule resides on the Scheduler node 104 which could store many more schedules for other zones. For each schedule, the data specifies the desired turning ON and OFF times for each lamp or group of lamps. The Real Time Clock 106 is there to insure that every node on the network will be synchronized with standard Time of Day As shown in FIG. 2A, for dimming purposes, a Lighting node 110 is added to the basic system and the light ballast 108 used must be of the dimmable type. An analog output (configurable but typically 0–10V) signal from the Lighting 110 is used to modulate the control input of the dimmable ballast 108 to vary the light level output of the lamp.

To close the control loop, at least one light level sensor 112 is used to measure the actual light level in the zone. The schedule command is sent at the same time to the Lighting 110 and the Relay Board 102. Therefore, the relay board 102 can energize the relay associated to the controlled zone when the schedule command is anything else than OFF and the Lighting 110 takes care of the light level requested by setting an appropriate light level set point on a PID controller.

For a better measurement of the overall light level in the zone, up to three light level sensors 112 can be connected to analog inputs of the Lighting controller 110. The three readings can be combined together according to a user selected algorithm (such as averaging) to give an adequate value for the overall light level in the zone. The PID loop inside the Lighting controller 110 uses this measurement and compares it with the light level set point dictated by the active schedule. Depending on the difference between the two levels and based on its configurable parameters, the PID will calculate the analog output to increase or decrease the dimming command delivered to the ballast regulating the light level in the zone.

It should be noted that the sensors can be used to monitor parameters other than light intensity level in a building area. Indeed, they can measure the heating, ventilation and air conditioning parameters, the refrigeration parameters (suction, pressure, condenser, subcooling), the temperature, pressure, humidity and power. The controller 110 can then be used to log data concerning these factors and report on them. The data collected on these parameters will most likely not affect the control of the delivery of artificial lighting but can be managed and logged by a single controller 110 to facilitate premise management.

Figure 2B:
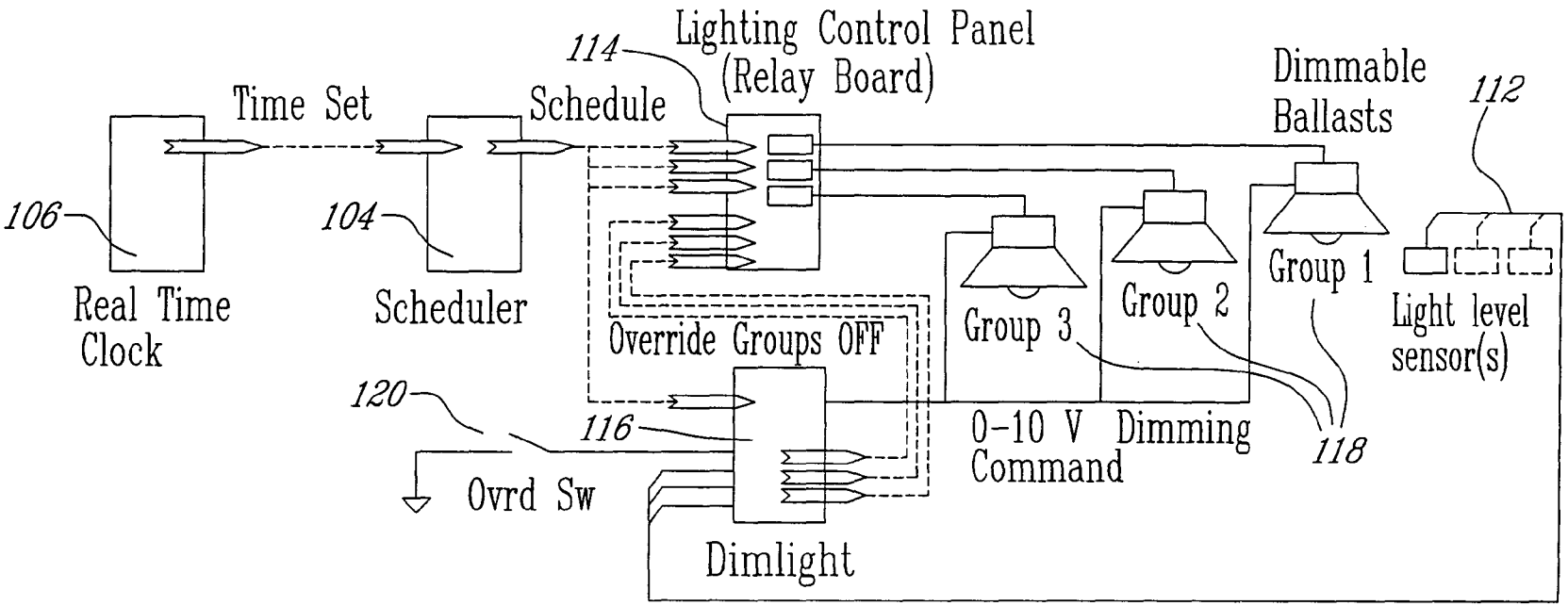
Figure 3A:
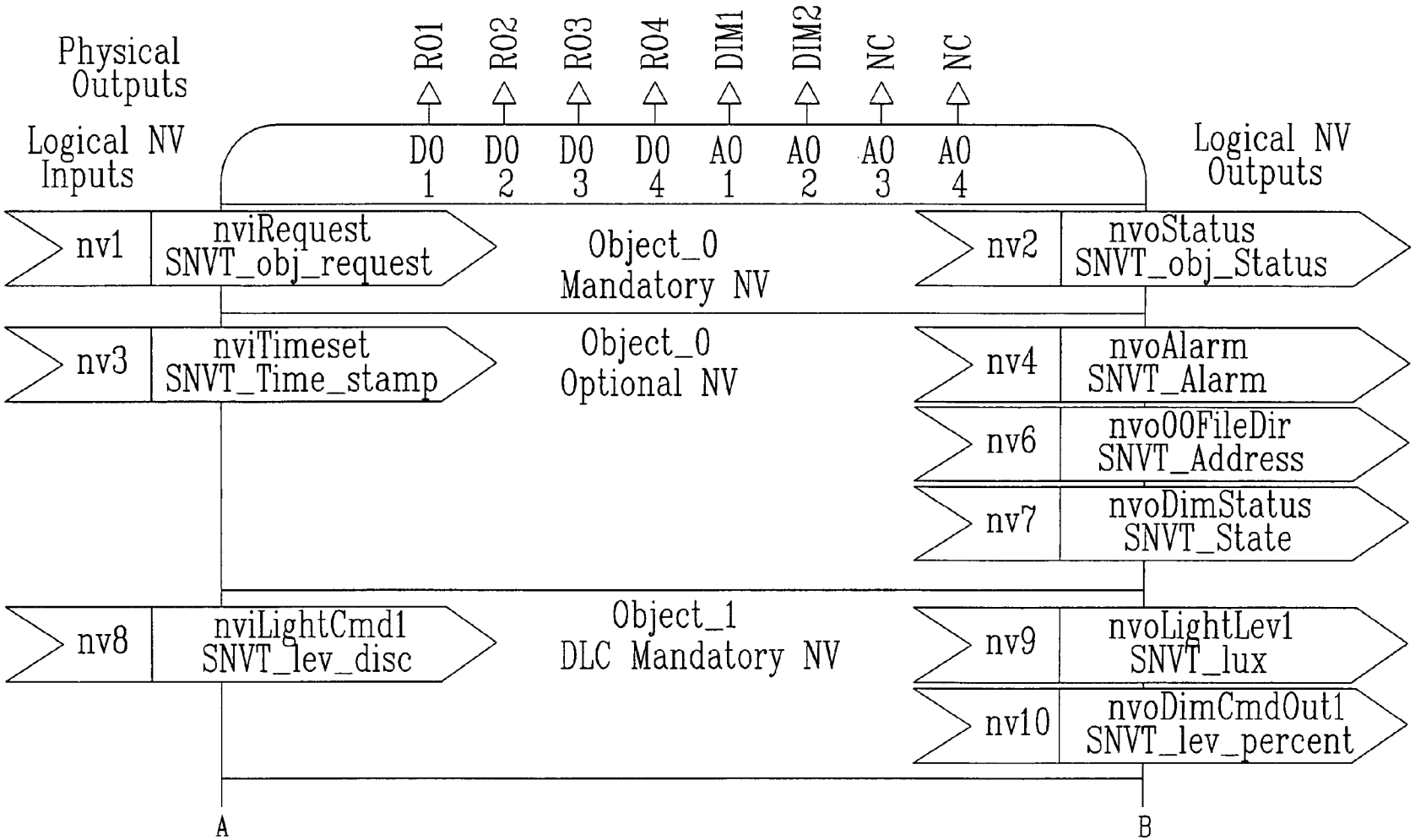
FIGS. 3A, 3B, 3C, 3D, 3E and 3F are the Controller Functional Profile.
Figure 3B:
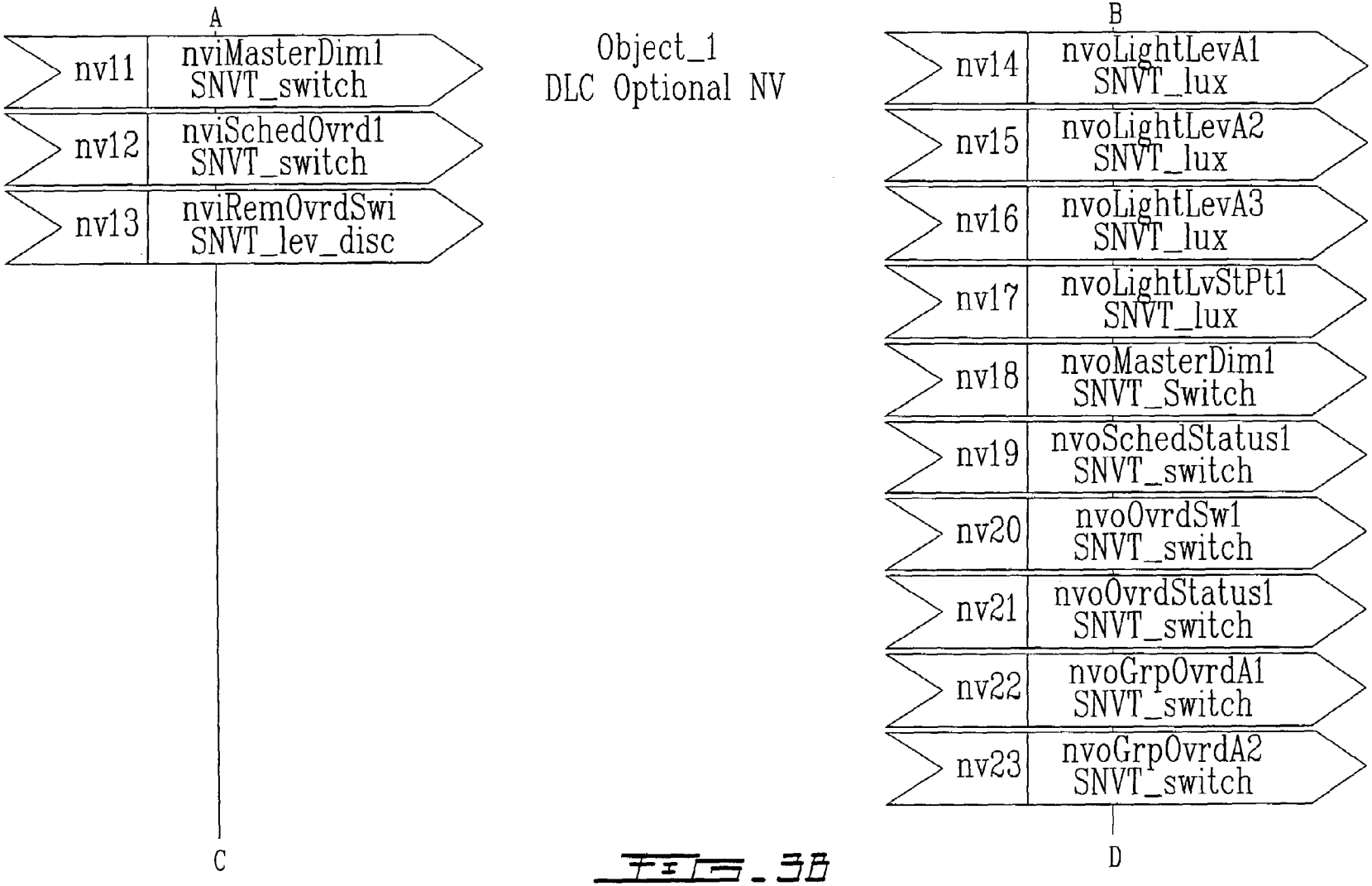
Figure 3C:
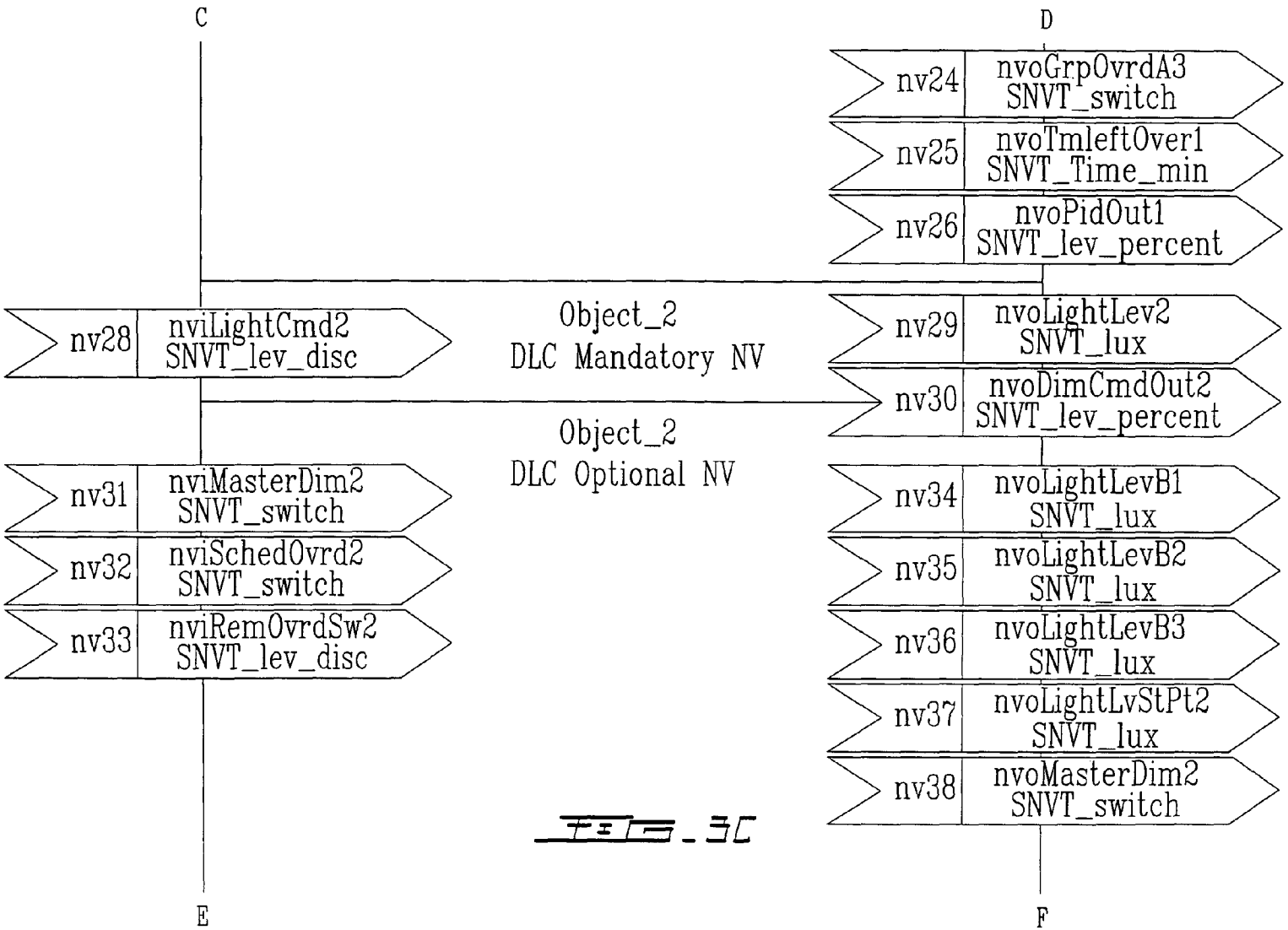
Figure 3D:
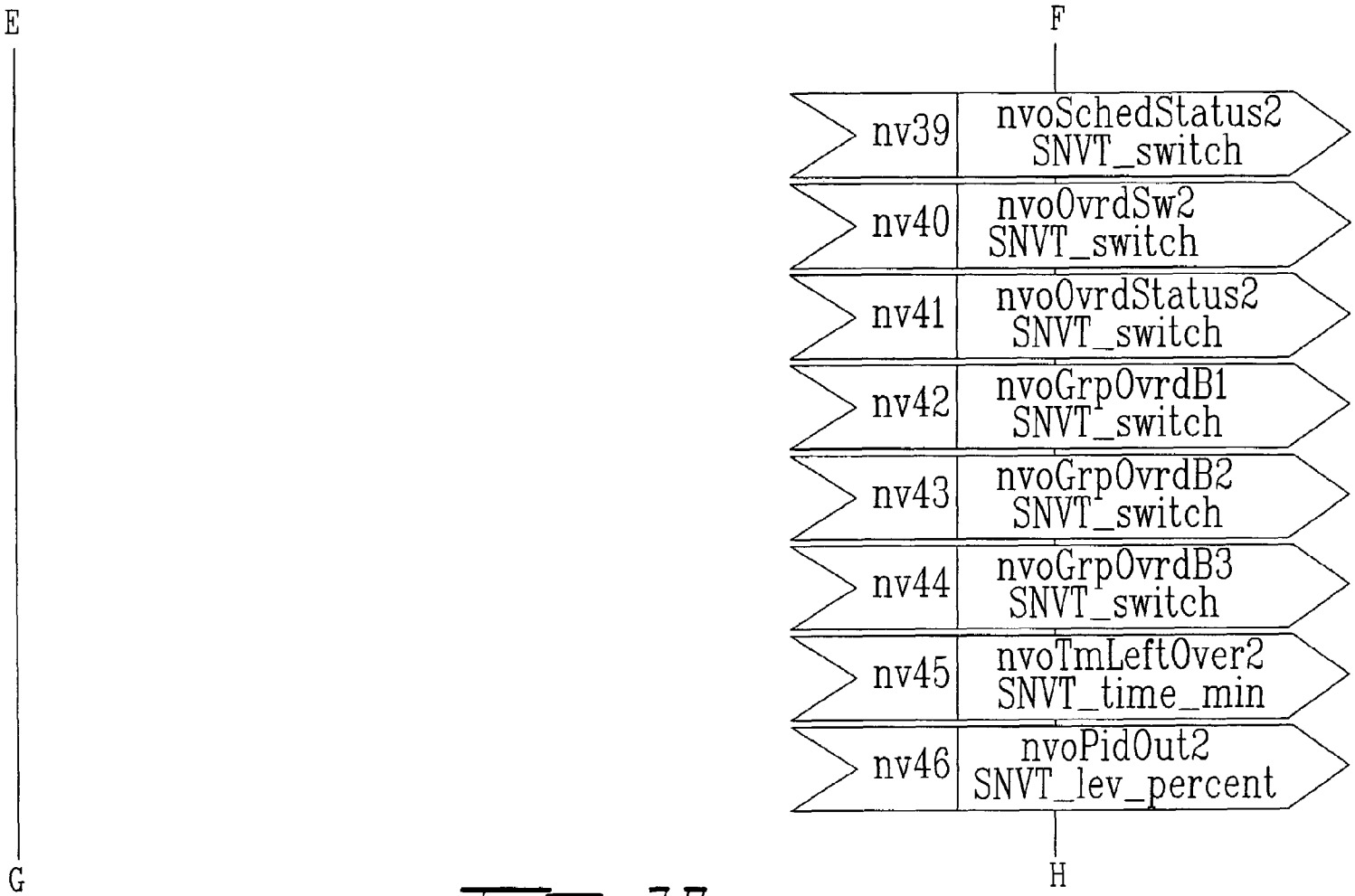
Figure 3E:
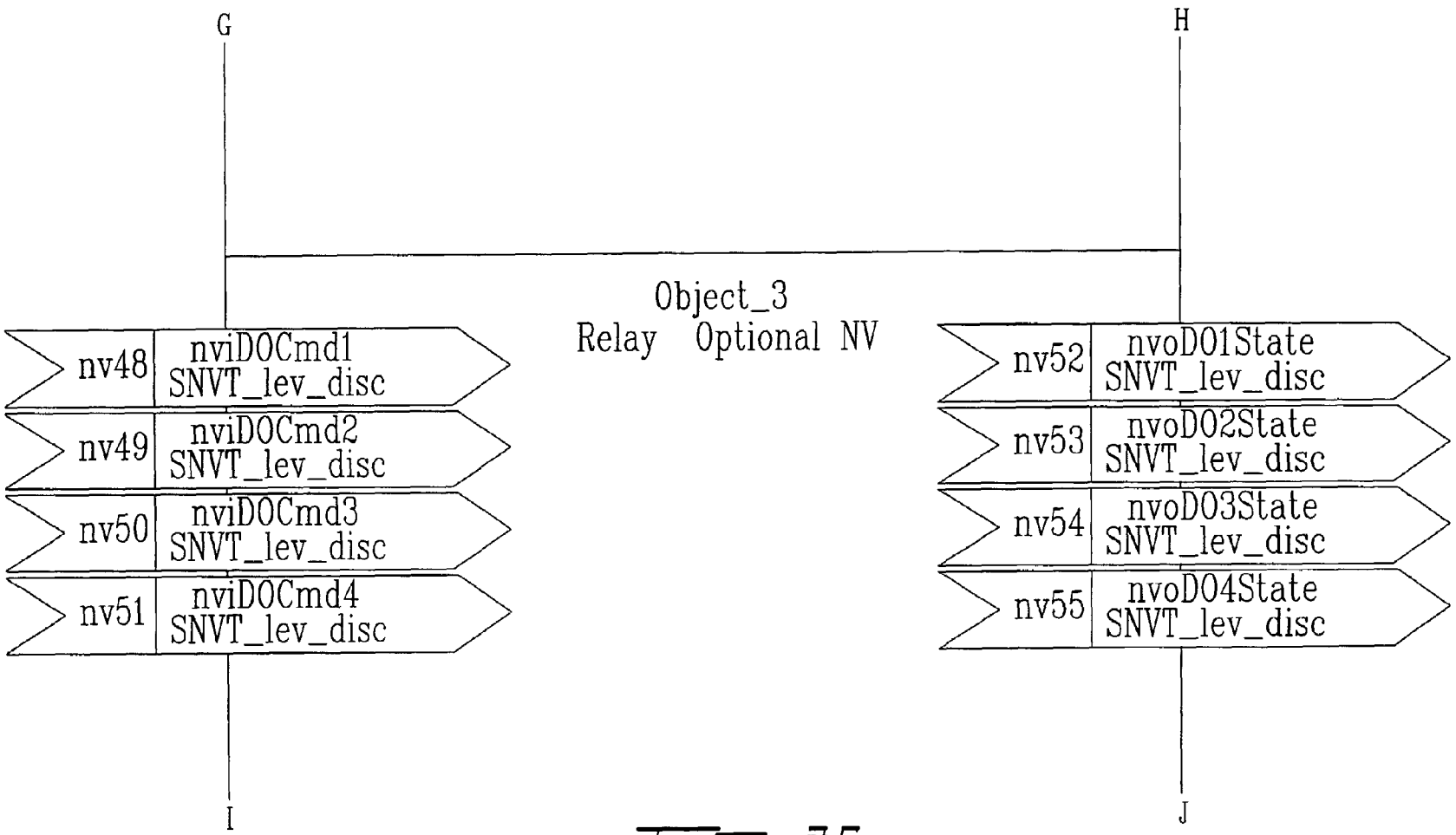
Figure 3F:
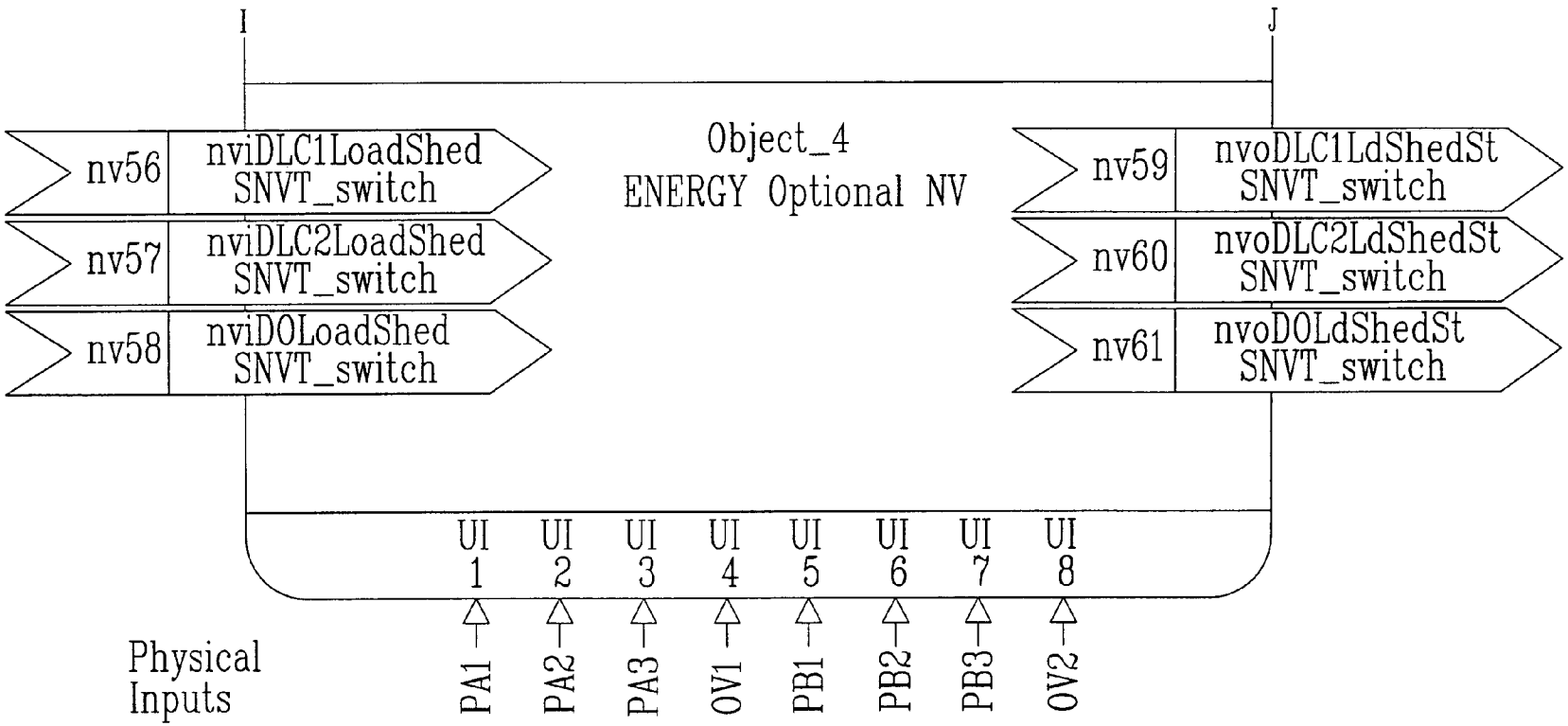

To improve energy savings in the case of buildings where natural light source input could be high, a zone could be divided in a plurality of groups of lamps, for example three groups of lamps. FIG. 2B shows such a configuration. Of course the lamp installation will have to be made accordingly. This kind of installation gives the opportunity to load shed a group of lamps if there is stable high light level condition in the zone even with lamps in full dimming state. In fact, this load shedding process can continue until all groups are shut off. The groups are turned ON again, one at a time, when the conditions go to a stable low light level in the zone without any active dimming command. The high light level and low light level are two conditions detected by the Lighting controller 116 using the light level sensors 112. But the power distribution to the ballast is the responsibility of the Relay node 114. Therefore, the Lighting controller 116 has to send a message to the Relay node 114 to manage the ON/OFF state of the groups of lamps 118.

Another improvement over conventional lighting systems is in the lamp replacement process. The load shedding is done by taking the runtime of the lamps into account. So the group which has the more run time will be load shed first and so on, extending the period between lamp replacement.

The purpose of load shedding is for places where electrical energy is not regulated. A building owner may then negotiate his price for energy and obtain a lower price if he keeps his consumption below a predetermined limit. If this limit is not respected, the price is then much higher.

In cases where there is an "Energy Manager" node (nviDLCLoadShed, nviDOLoadShed), a load shedding command may occur when the energy consumption level is near the predetermined limit. The controller will then change its command to ensure a lower energy consumption while ensuring a minimum of lighting in order to stay below the predetermined limit.

A switch 120 can be connected to an analog input of the Lighting controller 116 to override the actual light level of the zone to a predefined light level value. The override state is active as long as the switch stays in override position, for a toggle switch, or for a predefined duration each time a push button switch is pressed.

Preferably, each Lighting controller board implement two distinct Dimmable Lighting Control objects, DLC1 and DLC2 to control a maximum of two zones with one Lighting controller. Preferably, each zone can be divided in three groups for load shedding in high light level at full dimming condition. One can install as many nodes as needed to control all the zones of a building with this method.

Preferably, the Lighting application program runs on a board equipped with four Relay Outputs that can be used in place of another Relay board for a small installation or if all main Relay Boards are completely loaded and there is only a few more zones to control and there is no other relay board available. The board preferably has eight analog inputs configurable by software, four digital outputs (which form a C relay) protected by fuse and four configurable analog outputs (0–20 mA, 0–5 V, 0–10 V) protected by a current limit (max 25 mA).

Preferably, the Lighting interface runs on a software platform which is used to easily install and configure all the nodes involved in the Distributed Dimmable Lighting System and establish connection bindings between the nodes. The Lighting Interface is a user interface designed to facilitate the configuration process of the Lighting Controller and for monitoring and diagnostic purposes via a dynamic graphical display.

The LonMark Association promotes and supports the manufacturers that produce interoperable products which are the most basic components in the development of open systems such as the LonWorks system. The LonMark Association develops standards for interoperability, certifies products to those standards and promotes the benefits of interoperable systems.

The associated LonMark profile for the Lighting controller 116 is presented in FIGS. 3A, 3B, 3C, 3D, 3E and 3F. It is a description of the logical interfaces of the controller. It describes the network variables and their types used to connect and exchange information with other devices on the LonWorks network, the configuration properties used to customize the controller behavior and the physical I/O's used to control. In the LonMark guidelines, the object 0 (Node object) is used to describe and control all others objects of the node.

Physical Inputs/Outputs. The board used as the Lighting Controller has eight universal inputs UI 1–8 that support light level and switch sensors. It also has four digital outputs (relays) DO (1–4) and four analog outputs AO (1–4). Both digital and analog outputs can be temporarily overriden for maintenance purposes.

Some of the preferred interfaces of the Lighting Controller can be described as follows. The labels refer to the functional profile of FIGS. 3A, 3B, 3C, 3D, 3E and 3F.

TABLE 1

Description of the interfaces of the Controller.

| Label | Name | Description |
|---|---|---|
| R01<br>R02<br>R03<br>R04 | DO (1–4) | General purpose relays commended by the input network variables nvidocmd (1–4). The relays status is displayed on the corresponding nvodostate. |
| DIM1<br>DIM2 | AO (1–4) | Fully configurable analog outputs that can be configured by the interface to control in many supported ranges by voltage or current a variety of analog devices |
| nv1 | nviRequest | Input network variable used to send different standard requests to the node: to enable/disable alarms, to ask for the status of a specific object, to acknowledge an active alarm . . . The variable is fully described by the snvt_obj_request in the lonmark ressources. |
| nv2 | nvoStatus | Output network variable that presents the status of a node object following a request for updating status on the nvirequest. The status is a structure of 16 bits returning information about the actual physical and logical status of the object. The variable is fully described by the SNVT_obj_status in the lonmark ressources. |
| nv3 | nviTimeSet | Input network variable used to send periodically the curent date and time and synchronize an internal clock. The node will use this clock to time-stamp the alarms. |
| nv4 | nvoAlarm | Output network variable used to inform the alarm node and the PC of the alarm status of the dimmer node. This network variable is shared by all the objects that can generate alarms. The variable is fully described by the SNVT_alarm in the lonmark ressources. |
| nv6 | nvo00FileDir | Used internally by the LNS (Lonwork Network Services) in the process of transfering configuration parameters to/from the node. |
| nv7 | nvoDimStatus | Output network variable that inform the interface of the current status of the grafcets that controls the dimmers: waiting for schedule, preheat period, cooling period. |
| nv8<br>nv28 | nviLightCmd | Input network variable bound to the scheduler node that receives the current schedule. Many lighting nodes including dimmers can be feed from the same schedule. The scheduler node can send discrete values: max, med, low and off. These discrete values are converted by the dimmer node in illumination set points specified in the dimmers configuration |
| nv9<br>nv29 | nvoLightLev | Output variable that represents the calculated lighting level based on up to three illumination sensors. It is displayed in the interface for sensor validation strategy purposes but it can even |

TABLE 1-continued

Description of the interfaces of the Controller.

| Label | Name | Description |
|---|---|---|
| | | be logged so a trend graph can be presented to the user. |
| nv10<br>nv30 | nvoDimCmdOut | Output variable that represents the actual command value in percent that it is sent to the ballast. It is displayed in the interface for sensor adjusting purposes but it can even be logged so a trend graph can be presented to the user. |
| nv11<br>nv31 | nviMasterDim | Input network variable used to control from a single point the dimming percentage of many dimmers. |
| nv12<br>nv32 | nviSchedOvrd | Input network variable used to override temporarily the schedule indicated by the scheduler node. The override value can be specified in the "dimmer override" form and the duration of the override is the same as for the "remote override time". |
| nv13<br>nv33 | nviRemOvrdSw | Input network variable used to remotely override (the switch is located on another node that can be remote from the building area) the scheduled set point. The variable specifies if the override should be active and also the override set point value. |
| nv14<br>nv15<br>nv16<br>nv34<br>nv35<br>nv36 | nvoLightLev<br>(1–3) | Output variables that represent the values of preferably up to three illumination sensors. They are displayed in the interface for sensor adjusting purposes but they can even be logged so a trend graph can be presented to the user. |
| nv17<br>nv37 | nvoLightLvStPt | Output variable that represents the current set point of the dimmer. |
| nv18<br>nv38 | nvoMasterDim | Output network variable that represents the actual mater dim received on the nvimasterdim value. |
| nv19<br>nv39 | nvoSchedStatus | Output network variable that represents the actual value received from the scheduler. |
| nv20<br>nv40 | nvoOvrdSw | Output network variable that represents the actual value of the local/remote override switch. |
| nv21<br>nv41 | nvoOvrdStatus | Output network variable that represents the actual override status and value. |
| nv22<br>nv23<br>nv24<br>nv42<br>nv43<br>nv44 | nvoGrpOvrd<br>(1–3) | Output network variable that represents overrides for the node that controls the On/Off status of the groups of lights. It is used to shut down a lighting group when the illumination is over the specified maximum limit for a specified duration. |
| nv25<br>nv45 | nvoTmLeftOver | Output network variable that represents the remaining time for an override, load shedding depending on the current status of the dimmer. |
| nv26<br>nv46 | nvoPidOut | Output network variable that represents the actual PID value. It is displayed in the interface to adjust correctly the PID parameters. |
| nv48<br>nv49<br>nv50 | nviDOCmd<br>(1–4) | Input network variable that represents the actual command for the corresponding relay |

TABLE 1-continued

Description of the interfaces of the Controller.

| Label | Name | Description |
|---|---|---|
| nv51 | | (ON/OFF). |
| nv52<br>nv53<br>nv54<br>nv55 | nvoDOState<br>(1–4) | Output network variable that represents the actual status for the corresponding relay (ON/OFF). |
| nv56<br>nv57 | nviDLCLoadShed<br>(1–2) | Input network variable that represents the actual load shedding command for the corresponding dimmer. |
| nv58 | nviDOLoadShed | Input network variable that represents the actual load shedding command for the digital outputs (relays). |
| nv59<br>nv60 | nviDLCLdShedSt<br>(1–2) | Output network variable that represents the actual load shedding status for the corresponding dimmer. It is monitored by the interface and a trend graph can be presented to the user |
| nv61 | nvoDOLdShedSt | Output network variable that represents the actual load shedding status for the digital outputs (relays). It is monitored by the interface and a trend graph can be presented to the user. |
| UI | PA (1–3) | Group of light level sensors used to calculate the illumination level for the dimmer 1. Depending of the preferred application, this group contain at least one lighting sensor and at most three sensors used to calculate the lighting level of a specific area. If many sensors are present, the resulting illumination level will be calculated using the strategy specified in the interface. If one or many sensors are over/under exposed, they are eliminated from the calculation. |
| UI | OV 1 | Switch sensor used to initiate a local override of the dimmer 1. The local override set point and the duration is specified in the interface |
| UI | PB (1–3) | Group of light level sensors used to calculate the illumination level for the dimmer 2. Depending of the application, this group contain at least one lighting sensor and at most three sensors used to calculate the lighting level of a specific area. If many sensors are present, the resulting illumination level will be calculated using the strategy specified in the interface. If one or many sensors are over/under exposed, they are eliminated from the calculation |
| UI | OV 2 | Switch sensor used to initiate a local override of the dimmer 2. The local override set point and the duration is specified in the interface |

Figure 4:
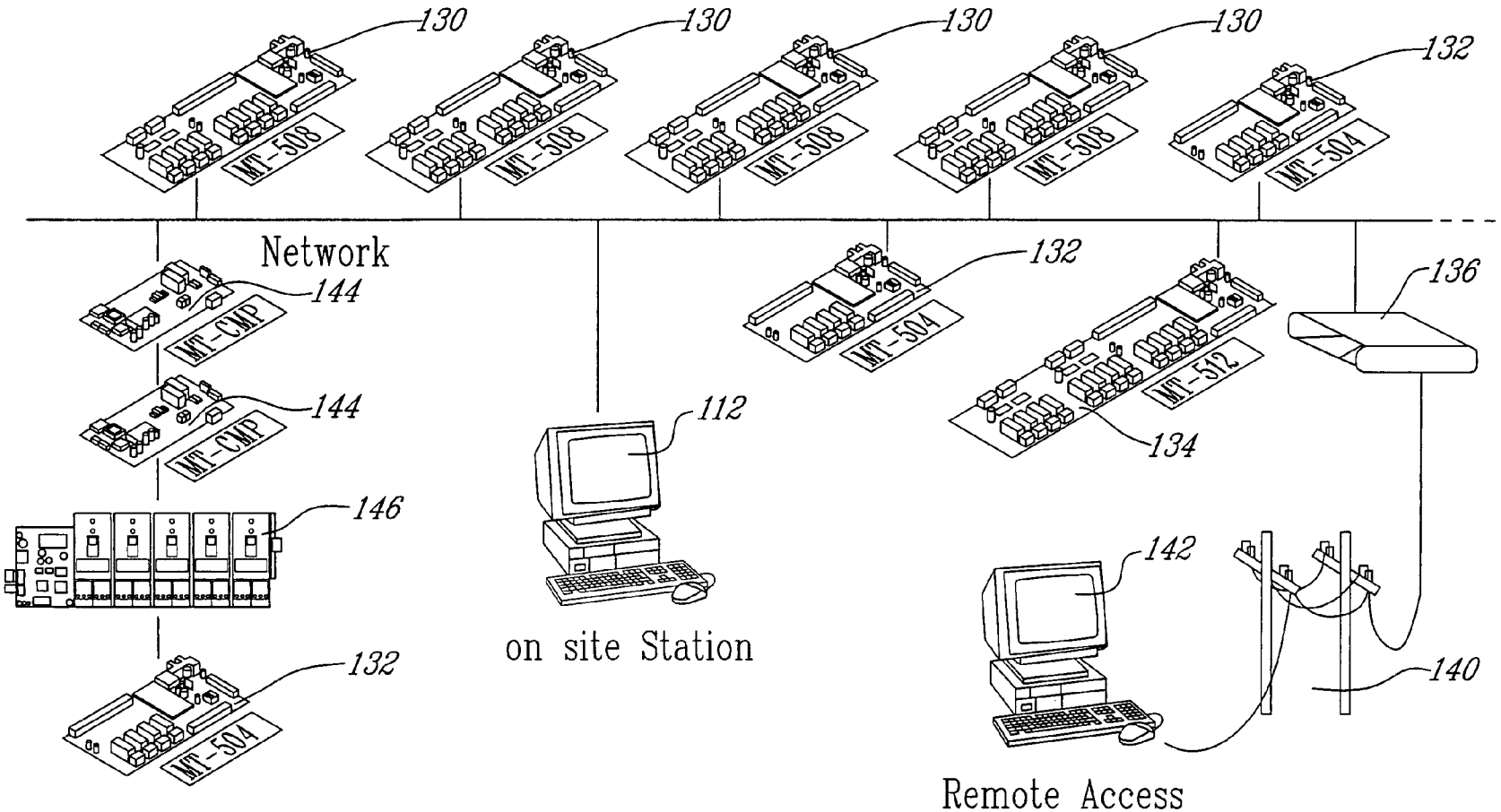
FIG. 4 is a graphical representation of a networked lighting control system.

FIG. 4 shows a networked lighting control system. Different versions of the board are illustrated to show compatibility with the network to create a control system customizable to any building and building area with any number of lamps, dimmable lamps and relay board. The four output board is identified by numeral 132. The eight output board by numeral 130 and the 12 output board by numeral 134. A station 112 is used to access the interface of the control system and a remote access can be set up on a remote station 142 using any telecommunications means such as a modem 136 and a telephone network 140. A cooling compressor controller 144 and its associated switching board 146 are shown on the same network as the lighting controller to illustrate that if all nodes respect the network policies and protocols, they can all exchange information and be logically connected.

Figure 5:
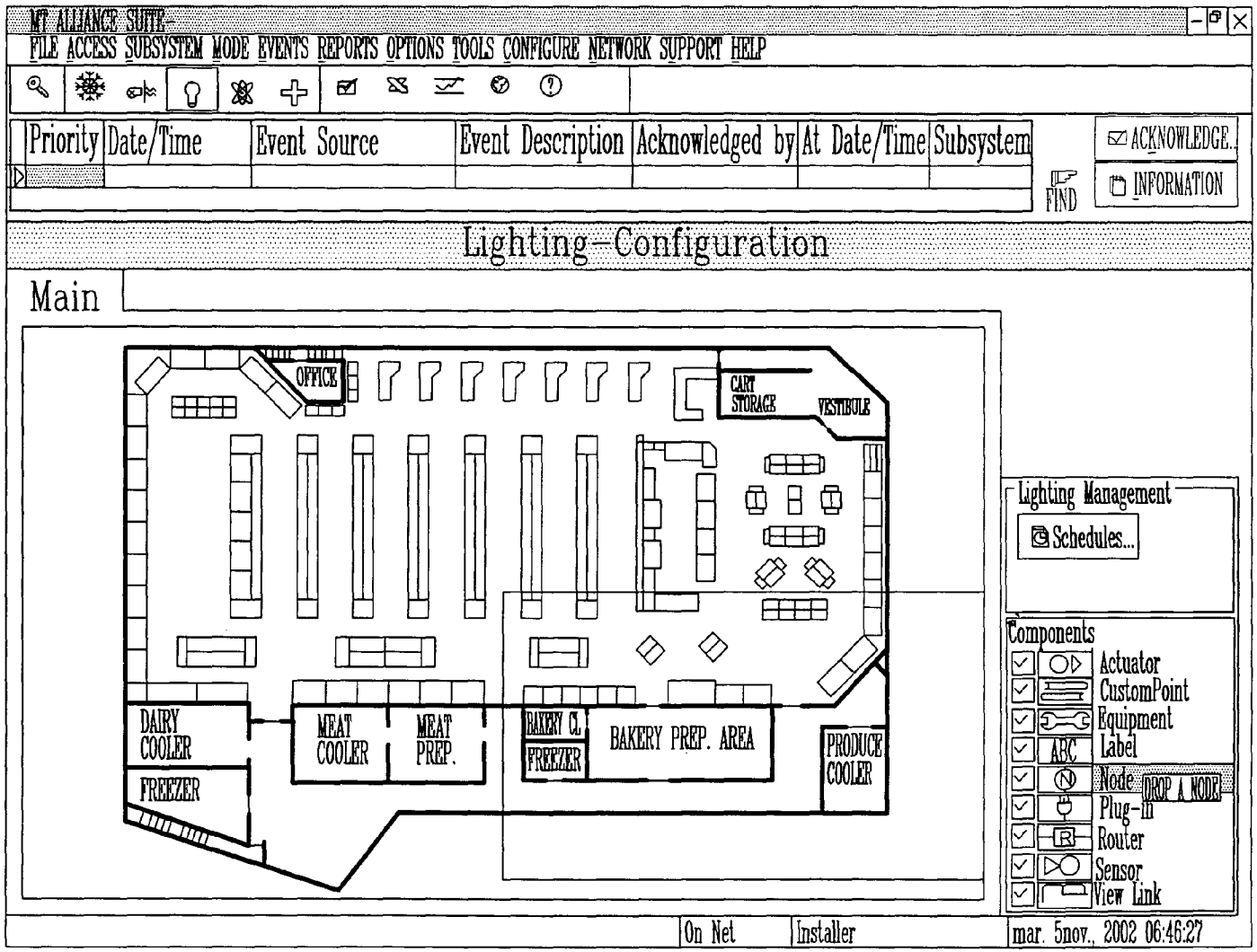
FIG. 5 is a graphical illustration of the interface of the control system showing a building area for which lighting is to be controlled.

FIG. 5 is a graphical illustration of the interface of the control system showing a building area for which lighting is to be controlled. In order for the interface to properly correspond to the control system, the nodes of the system must be created in the interface and linked to the physical outputs and inputs of the board.

Figure 6:
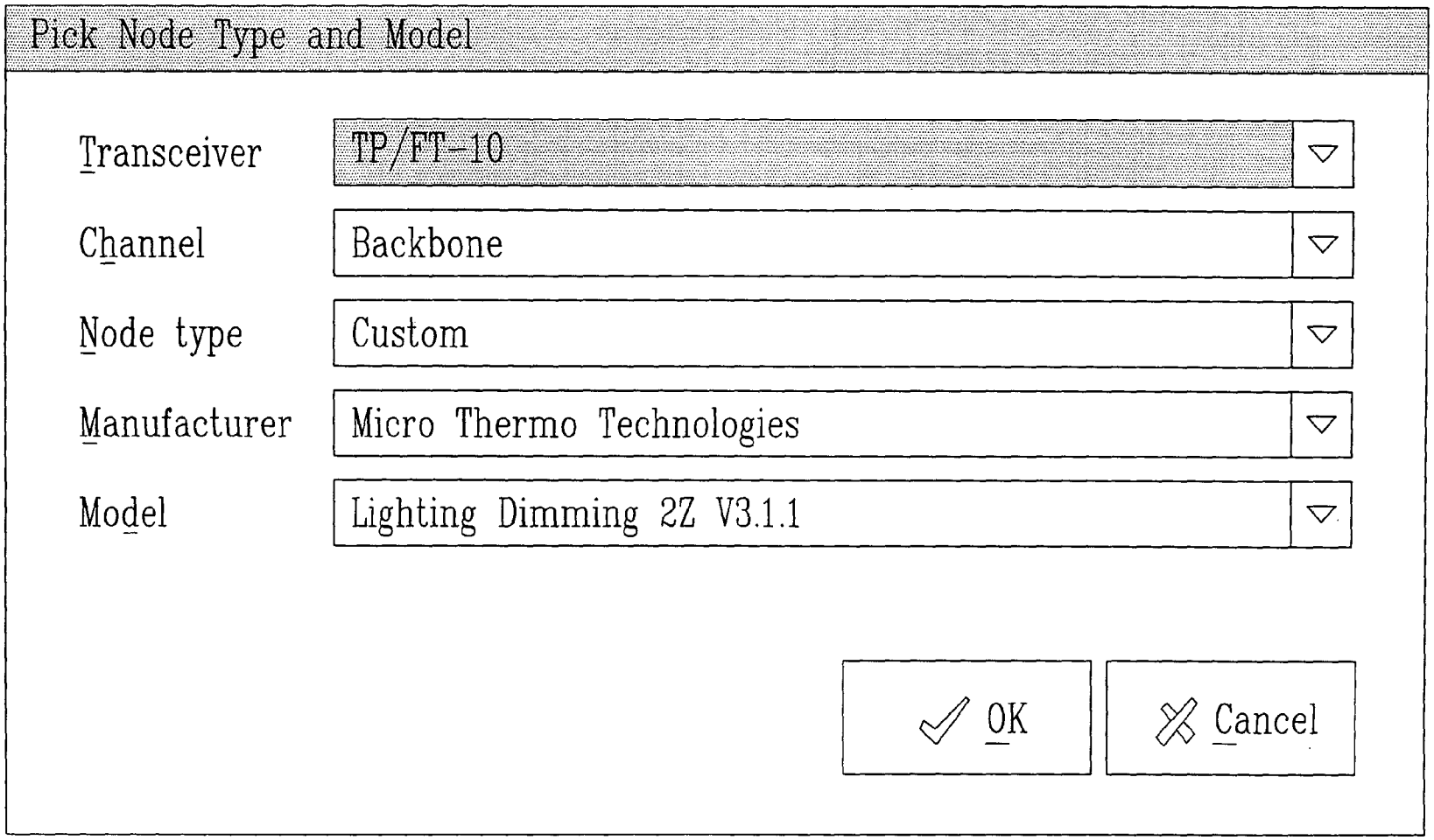
FIG. 6 is a graphical illustration of the interface of the control system showing the creation of a node of the lighting system.

FIG. 6 is a graphical illustration of the interface of the control system showing the creation of a node of the lighting system.

Figure 7:
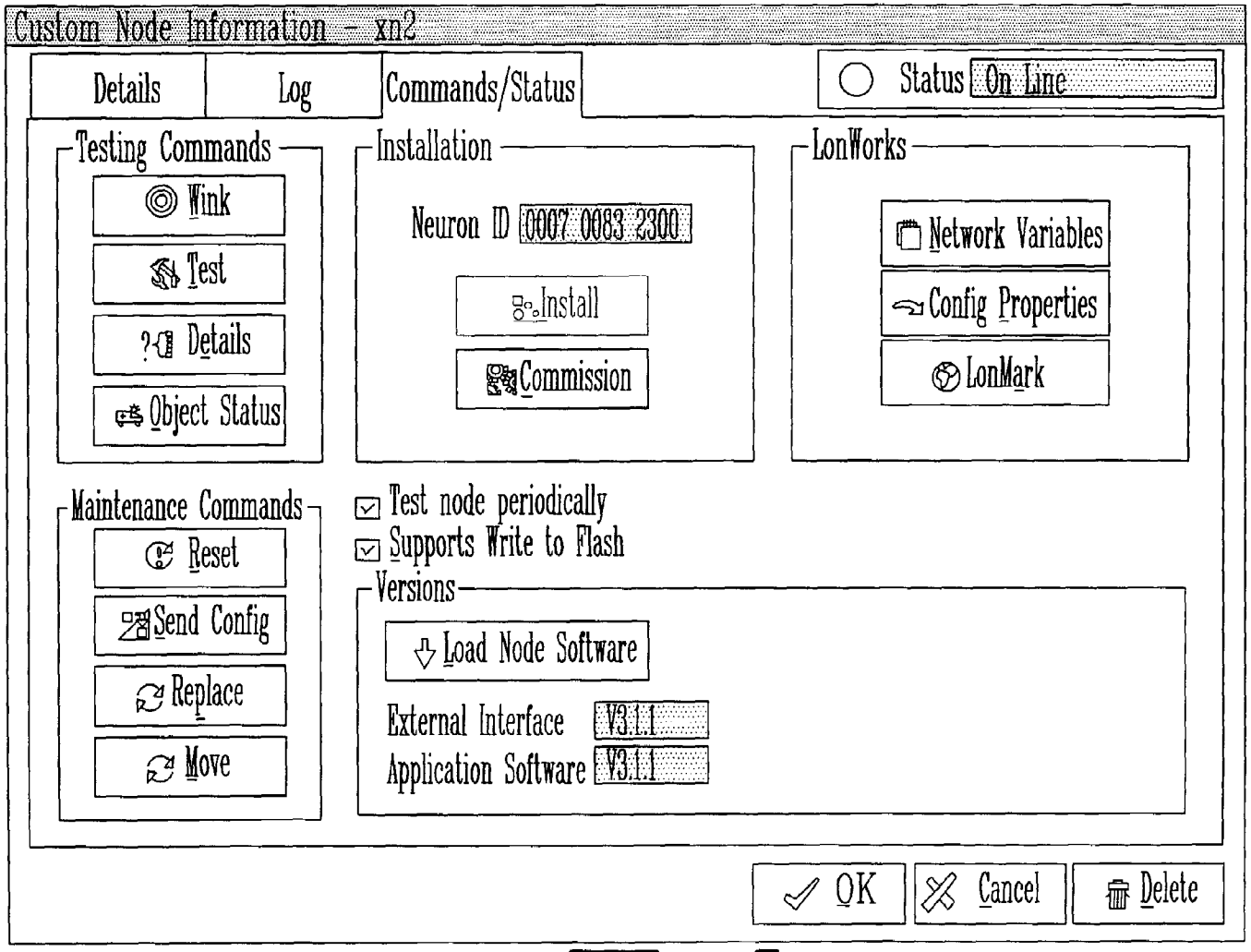
FIG. 7 is a graphical illustration of the interface of the control system showing the parameters to be loaded for the node of FIG. 6.

FIG. 7 is a graphical illustration of the interface of the control system showing the parameters to be loaded for the node of FIG. 6 to be created. These are standard network parameters that need to be configured for each node in order for it to be able to communicate on the network with the interface and the other components.

Figure 8:
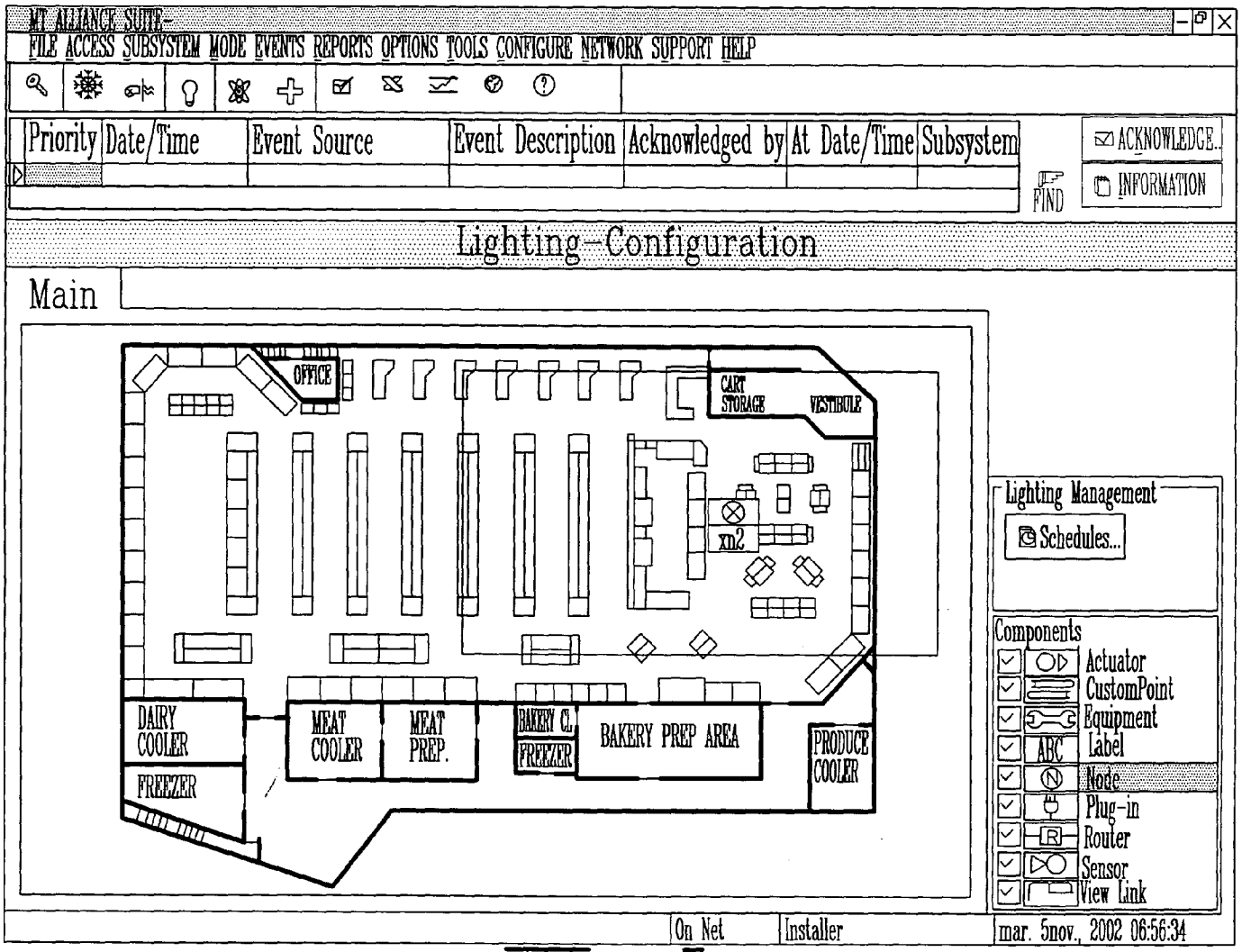
FIG. 8 is a graphical illustration of the interface of the control system showing the building area of FIG. 5 in which the node of FIG. 6 and FIG. 7 has been created.

FIG. 8 is a graphical illustration of the interface of the control system showing the building area of FIG. 5 in which the node of FIG. 6 and FIG. 7 has been created. The system installer would continue to virtually install all the nodes and assign them to physical inputs and outputs. He would then test each node to ensure proper functioning.

Figure 9:
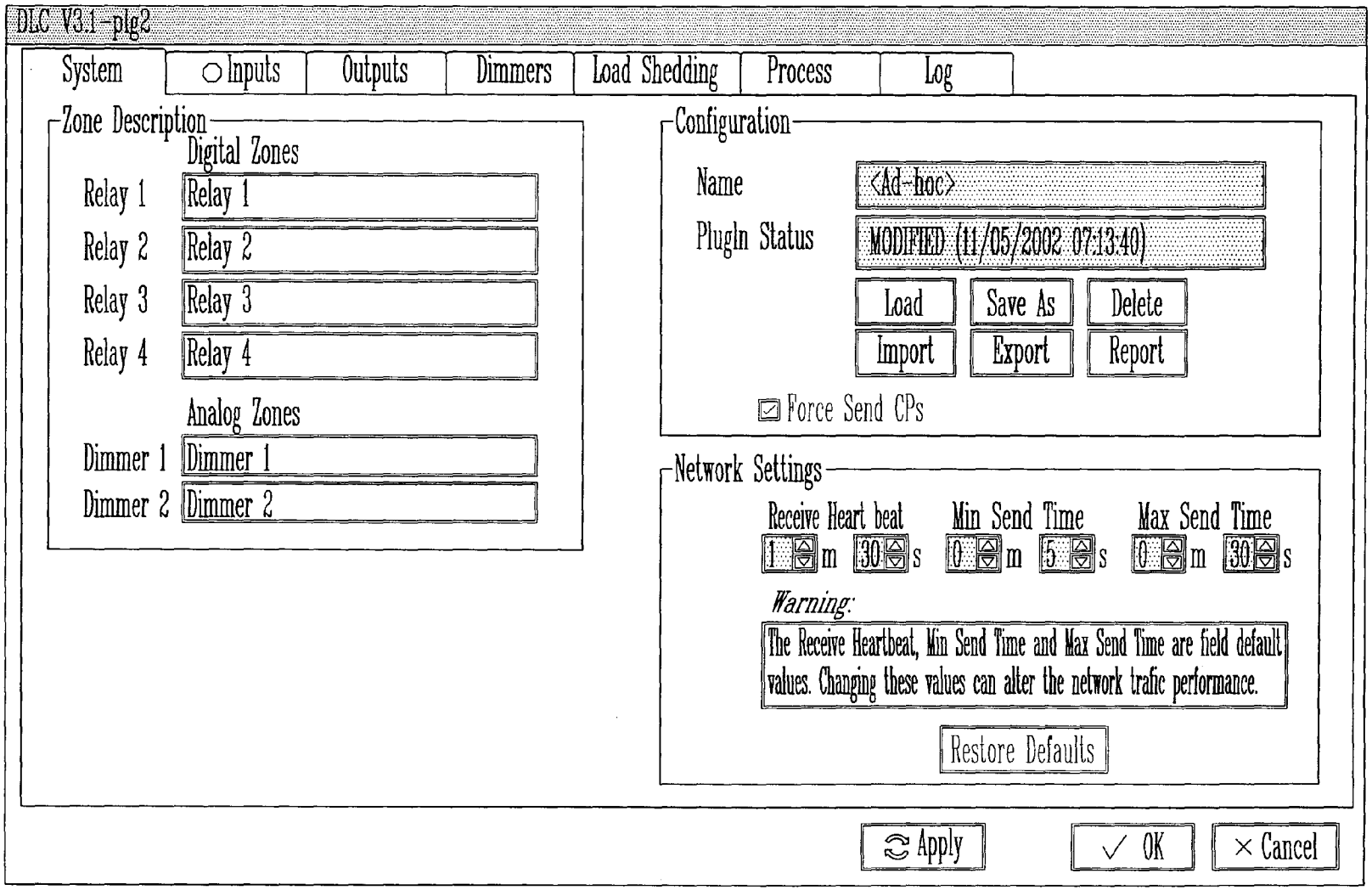
FIG. 9 is a graphical illustration of the interface of the control system showing the system parameters for the control system.

FIG. 9 is a graphical illustration of the interface of the control system showing the system parameters for the control system.

Figure 10:
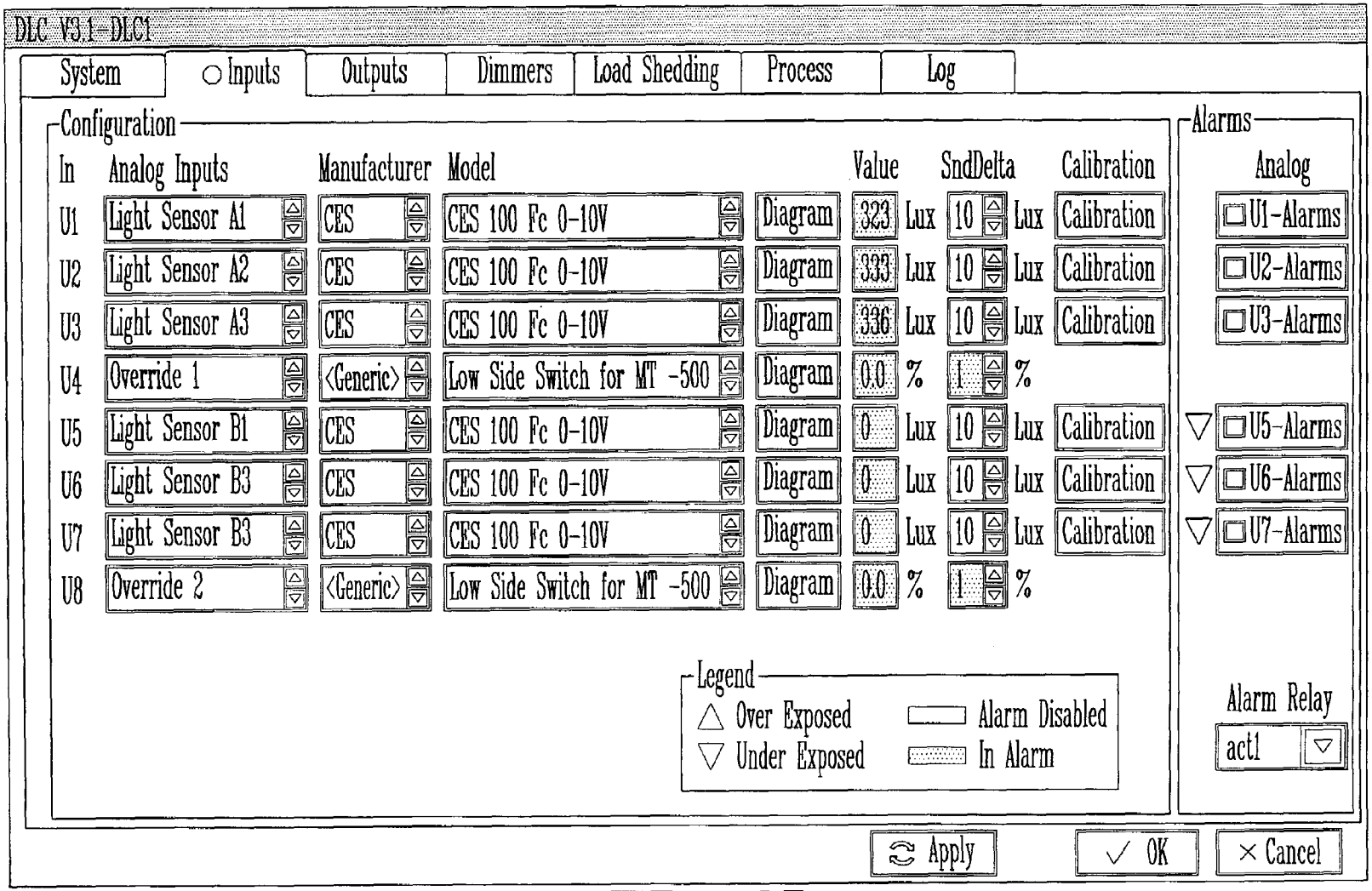
FIG. 10 is a graphical illustration of the interface of the control system showing input parameters for the control system.

FIG. 10 is a graphical illustration of the interface of the control system showing input parameters for the control system. Typically, the sensors are the override buttons are the analog inputs. Alarms for the sensors can be displayed if they are over-exposed, under-exposed, disabled or in alarm. Calibration tools are available to ensure proper readings of the sensors.

Figure 11:
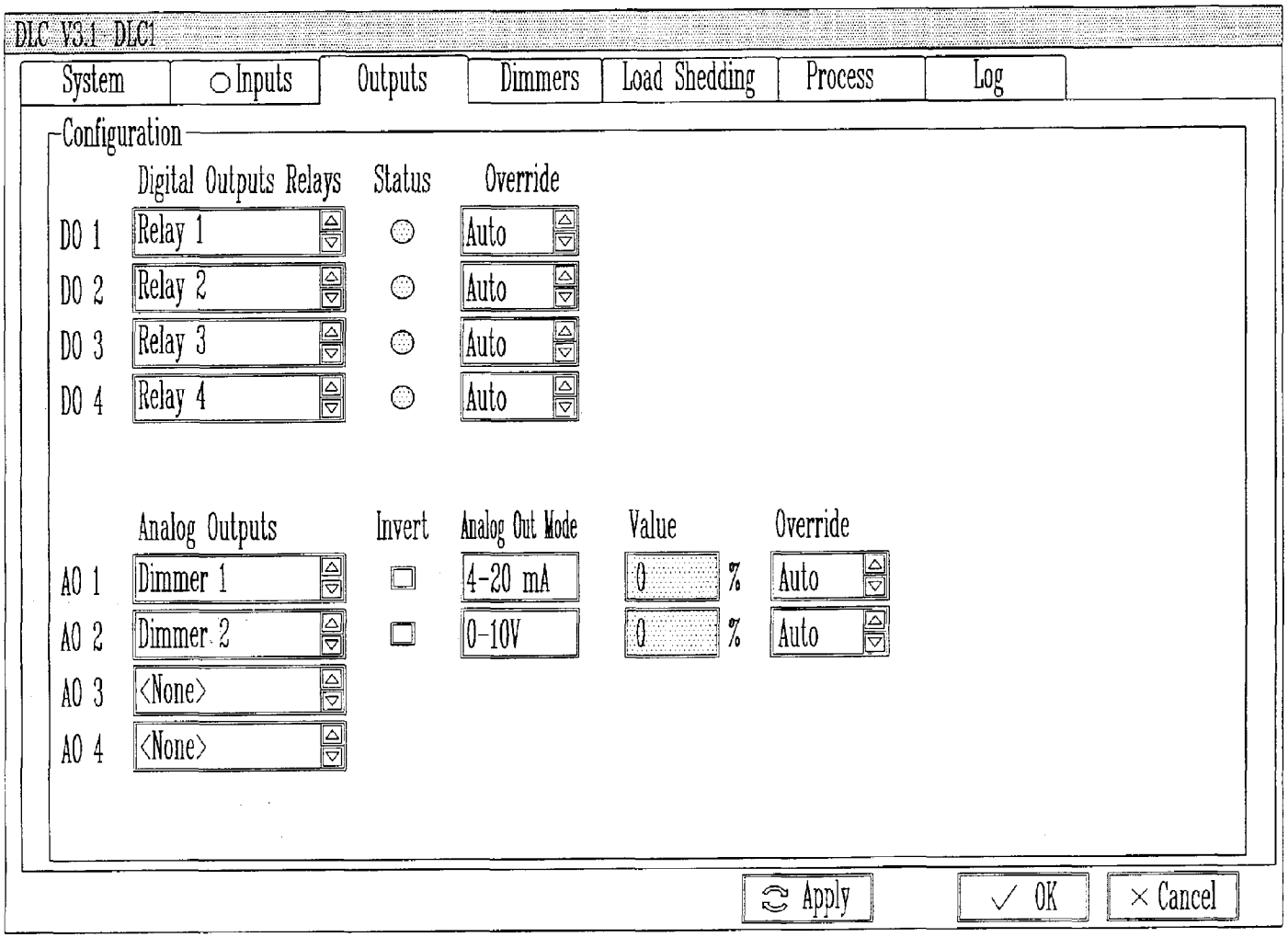
FIG. 11 is a graphical illustration of the interface of the control system showing the output parameters for the control system.
Figure 11:
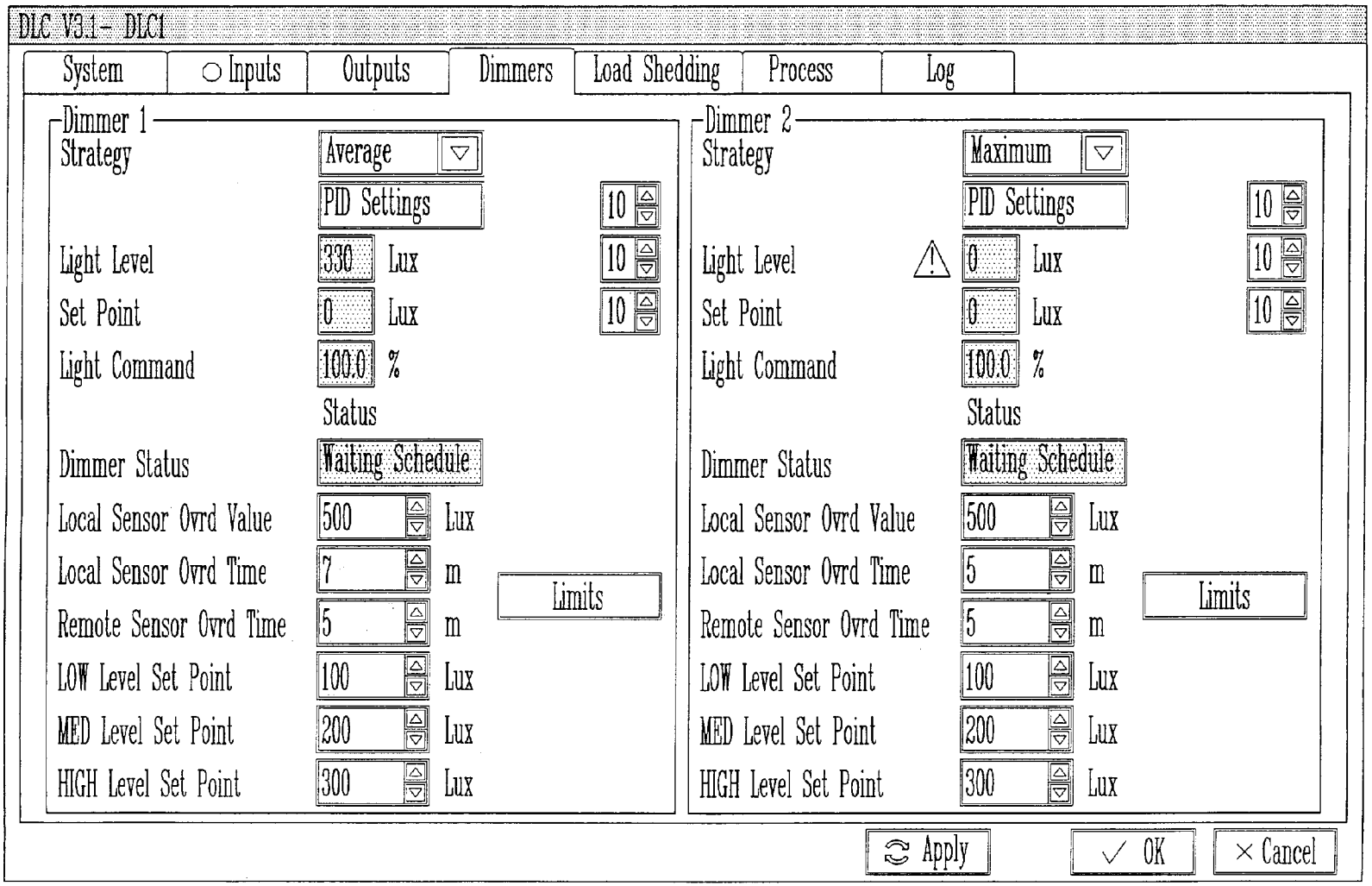

FIG. 11 is a graphical illustration of the interface of the control system showing the output parameters for the control system. Typically, the digital outputs are connected to the relays and the analog outputs to the dimmers.

The preferred interfaces for the Relay, which is another LonMark object and which controls the four digital outputs (relays) of the controller and can be used as a general purpose relay block in installations where an other relay node would be required are described in the above Table 1.

The configuration parameters for the Dimmer, which is a LonMark object, are set in the "Dimmers" tab of the interface, shown in FIG. 12. The strategy is chosen from the list consisting of Minimum, Maximum and Average. The DLC installer can choose for any dimmer one of the strategies to use for the calculation of the illumination level, based on the values from the installed illumination sensors. Preferably, there is also a sensor validation algorithm that will exclude a sensor being over/under exposed. The PID Settings of FIG. 13 are a group of parameters used to adjust the PID loop. The Local Sensor Ovrd Value represents the illumination set point to use when the local override switch is pushed. The Local Sensor Ovrd Time represents the duration of the override when the local override switch is pushed. The Remote Sensor Ovrd Time represents the duration of the override when a remote override command is received on the nviRemOvrdSw input variable.

The LOW Level Set Point represents the set point value when a LOW schedule command is received. The MED Level Set Point represents the set point value when a MED schedule command is received. The HIGH Level Set Point represents the set point value when a HIGH schedule command is received.

The Limits are a group of parameters used to customize the Dimmer in order to respect the lamps' parameters. The interface object for setting up the limits is shown in FIG. 14: The Lamp Preheat Time represents the period of time after the lamps are powered, before the dimming can be active. This is specified by the lamp manufacturer. The Lamp Cooling Time represents the period of time after the lamps are turned off before they can be turned on again. It is also specified by the lamp manufacturer. The Start Lighting Automatically represents the condition to start automatically the lighting when the illumination level is under the predetermined level and for the entire period specified. The groups will be activated one after the other starting with the one that has the minimum run time, to extend the duration of the re-lamp period. The Stop Lighting Automatically represents the condition to stop automatically the lighting when the illumination level is above the predetermined level and for the entire period specified. The groups will be powered off one after the other.

Figure 15:
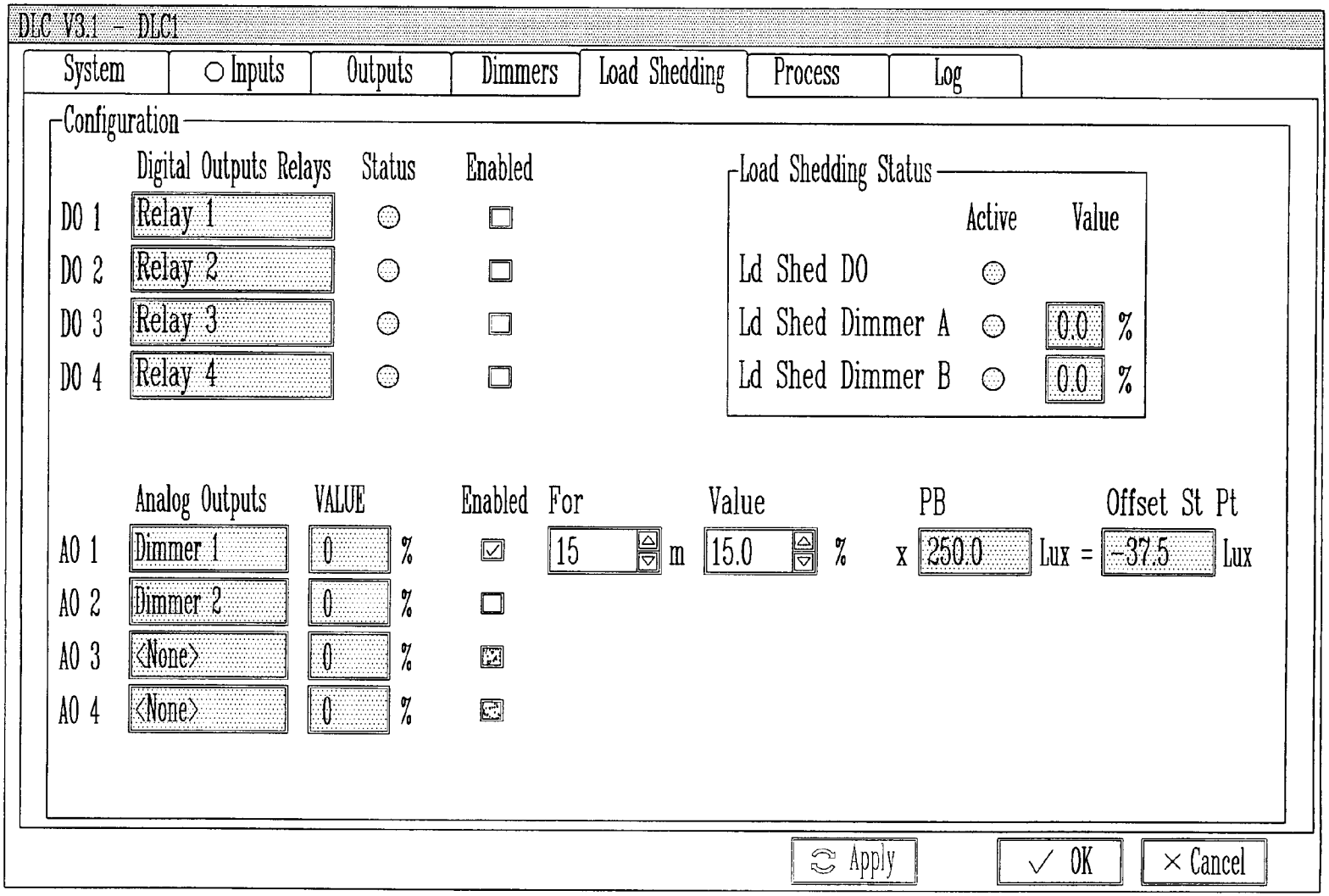
FIG. 15 is a graphical illustration of the interface of the control system showing the load shedding parameters for the control system.

FIG. 15 is a graphical illustration of the interface of the control system showing the load shedding parameters for the control system. For a Digital Output (relay) one can specify if the relay will be affected by a load shedding command on the nviDOLoadShed variable by changing the "Enabled" check box. If this check box is not checked the relay will not be affected. For a dimmer, the load shedding can be enabled when the "Enabled" check box is checked. In this case, when a load shedding command is received on the corresponding nviDLCLoadShed (1–2) variable, the dimmer's set point will be offset with a value calculated with the formula: OffsetSP=K*PB, where K is a multiplication factor and the PB is the proportional band parameter specified when configuring the PID bloc for the specified dimmer. For both of the load shedding types (relays and dimmers), the duration of the load shedding period can be specified.

Figure 16:
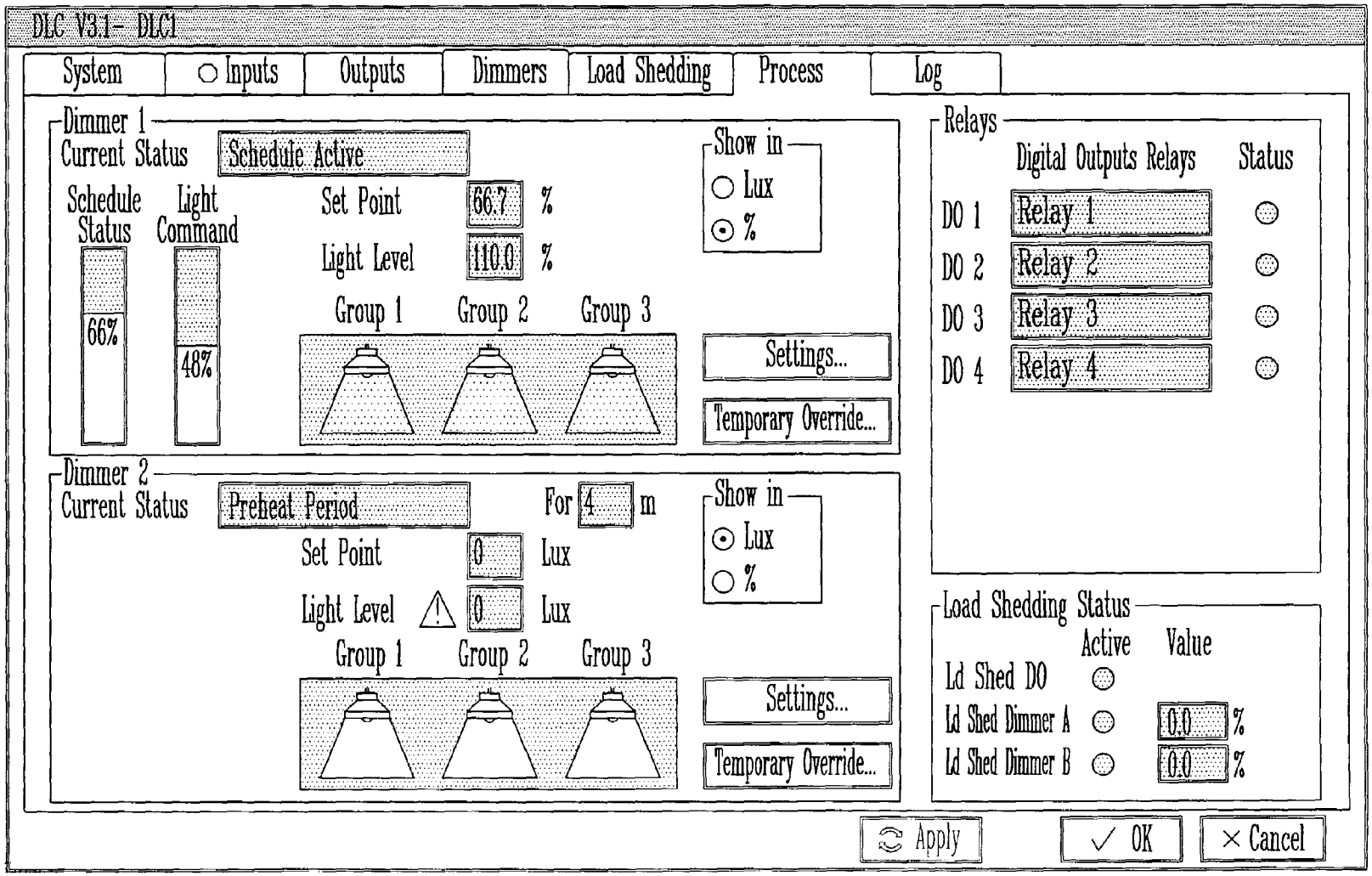
FIG. 16 is a graphical illustration of the interface of the control system showing the live performance process status.

FIG. 16 is a graphical illustration of the interface of the control system showing the live performance process status. In this particular example, the dimmer controls three lamps. A graphical representation can illustrate the level of illumination of the lamps, for example using a grayscale representation. The parameters can be shown in Lux or in percentages. The connections to the relays are also displayed as well as the load shedding status. This page gives the global status of the lighting system according to the control system. Temporary overrides of the status can be triggered from this status page.

Figure 17:
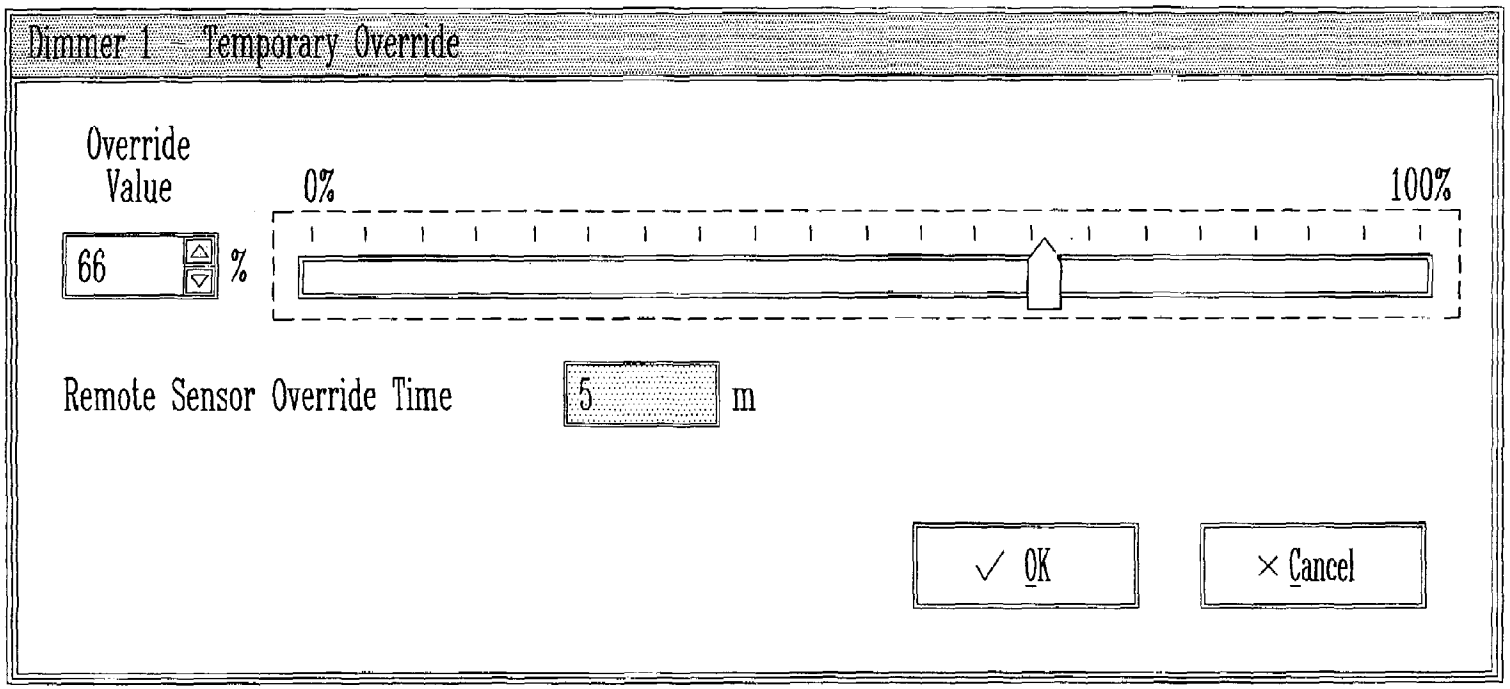
FIG. 17 is a graphical illustration of the interface of the control system showing a temporary override setting.

FIG. 17 is a graphical illustration of the interface of the control system showing a temporary override setting. It is preferably set using a percentage value for a specified time.

Figure 18:
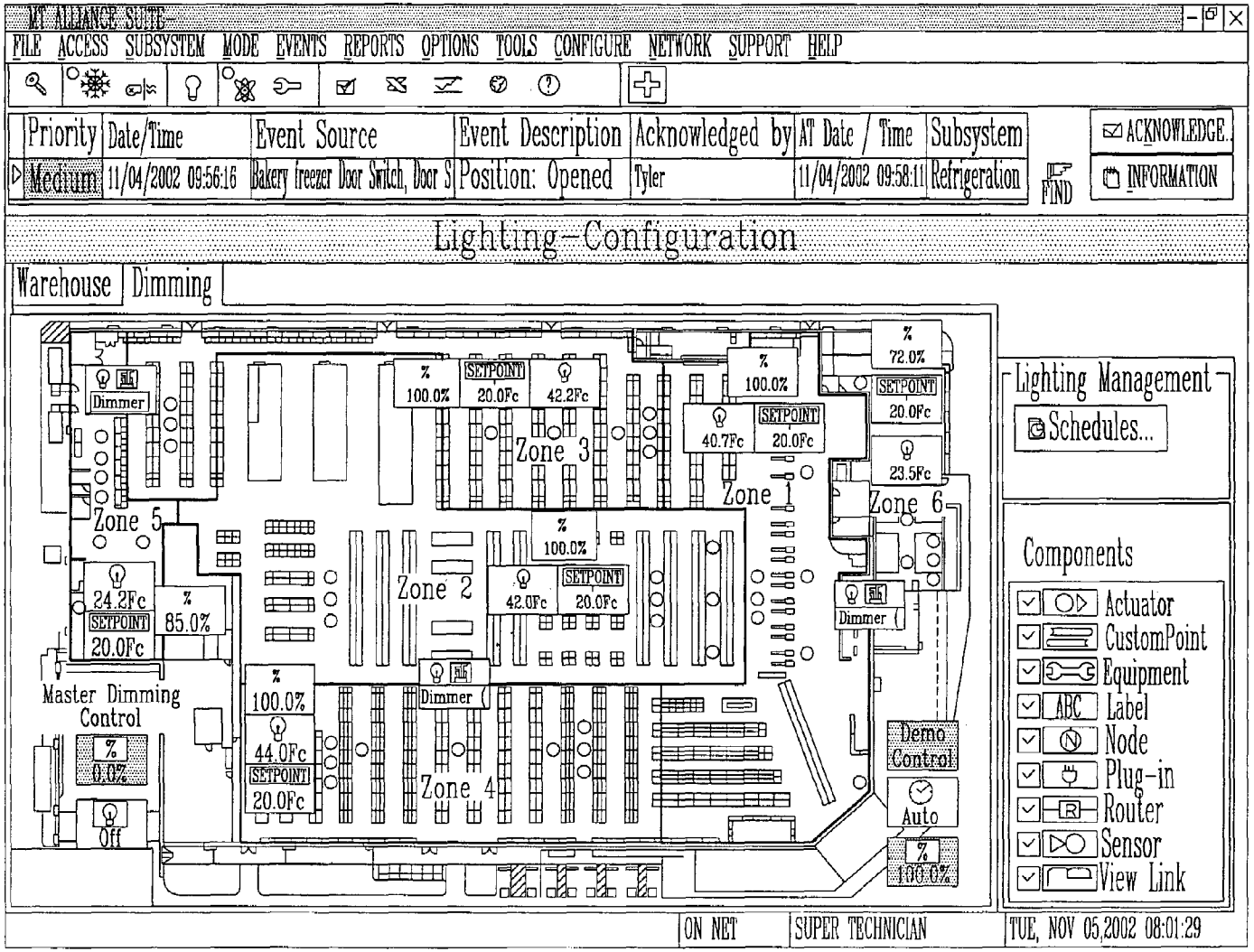
FIG. 18 is a graphical illustration of the interface of the control system showing an example building area with a plurality of nodes in operation and being controlled by the control system.

Logged data from an example site is finally presented as an example. FIG. 18 is a graphical illustration of the interface of the control system showing an example building area with a plurality of nodes in operation and being controlled by the control system. Each lamp is represented by a small circle with a color representing its approximate illumination level. The sensor values are pictographically represented together with the predetermined levels requested by the user. The building areas or zones are also clearly identified. It should be noted that the zones near the edges of the building where windows are present are at less than 100% of artificial illumination, whereas the internal zones are operating at 100% of artificial illumination. However, even at 100% illumination, some lamps are turned off, some are dimmed anywhere between a very low level to a full illumination.

Figure 19:
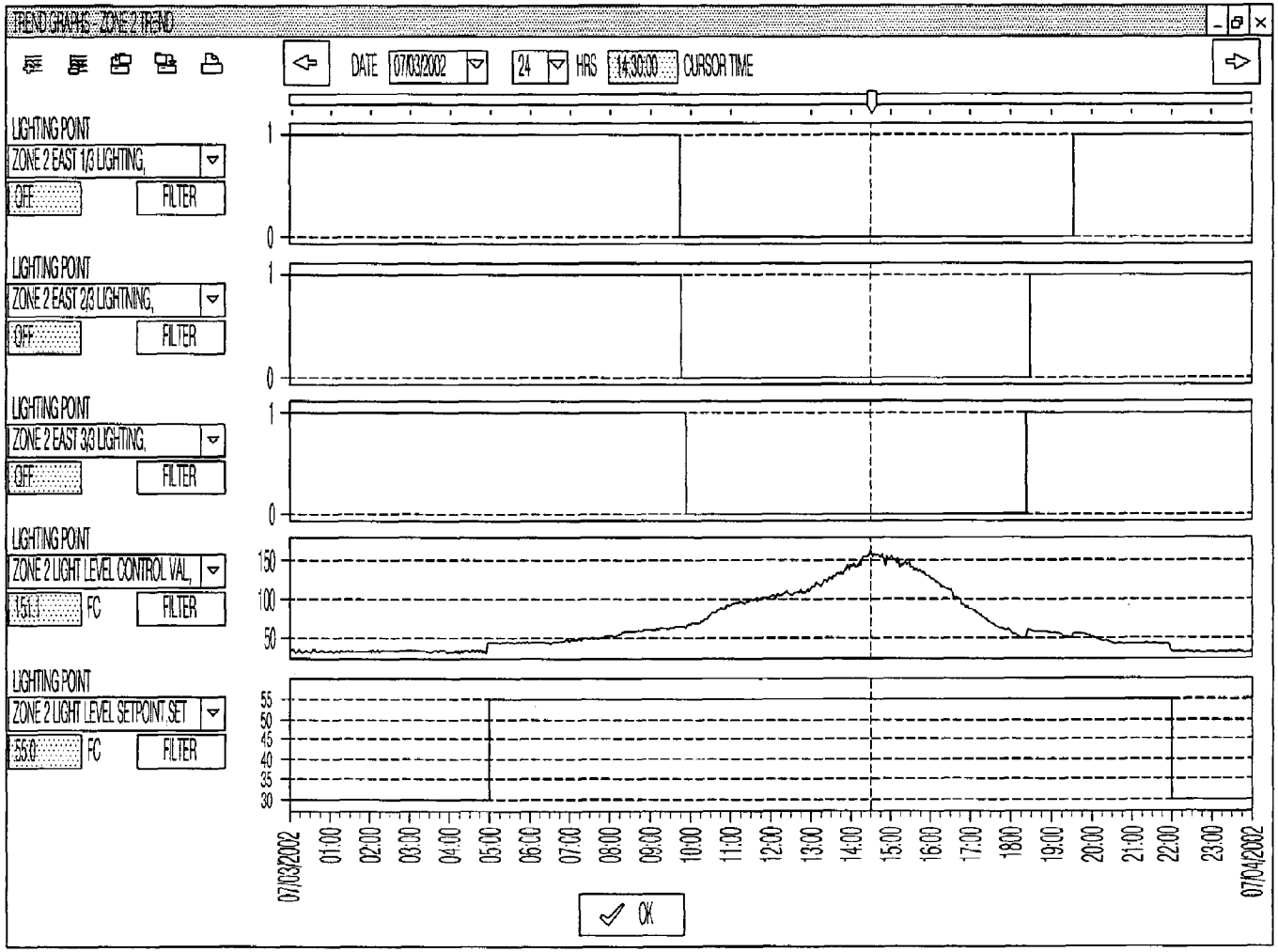
FIG. 19 is a graphical illustration of the interface of the control system showing a log of data collected in the building area of FIG. 18 on Jul. 3, 2002.
Figure 20:
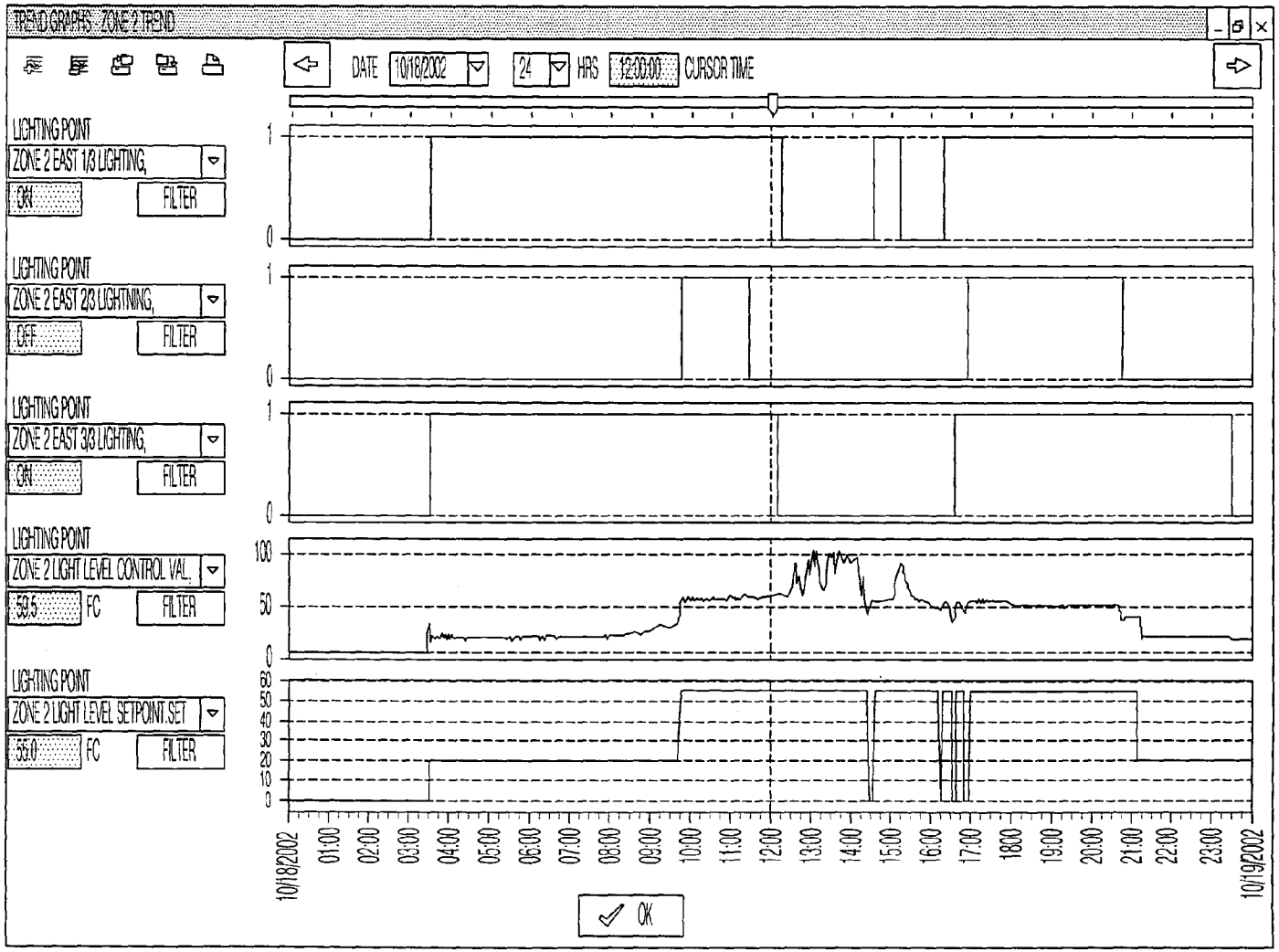
FIG. 20 is a graphical illustration of the interface of the control system showing a log of data collected in the building area of FIG. 18 on Oct. 18, 2002.

FIG. 19 is a graphical report of a log of data collected in zone 2 of the example building area of FIG. 18 on Jul. 3, 2002. FIG. 20 is a graphical report of a log of data collected in zone 2 of the example building area of FIG. 18 on Oct. 18, 2002.

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment.

It will be understood that numerous modifications thereto will appear to those skilled in the art. Accordingly, the above description and accompanying drawings should be taken as illustrative of the invention and not in a limiting sense. It will further be understood that it is intended to cover any variations, uses, or adaptations of the invention following, in general, the principles of the invention and including such departures from the present disclosure as come within known or customary practice within the art to which the invention pertains and as may be applied to the essential features herein before set forth, and as follows in the scope of the appended claims.

What is claimed is:

1. A method of maintaining an ambient light intensity in a building area at a predetermined level, comprising:

providing a predetermined level of light intensity for said building area;

providing at least one lamp in said building area, wherein at least one of said at least one lamp is a dimmable lamp;

providing at least one additional lamp in said building area, wherein each said additional lamp is one of a dimmable lamp and a lamp not capable of being dimmed;

obtaining an ambient light intensity level for said building area, said ambient light intensity level being a combination of a natural light level and an artificial light level;

comparing said ambient level to said predetermined level of light intensity;

if said ambient level differs from said predetermined level, calculating an artificial lighting input to be generated by said at least one lamp and said at least one additional lamp in said building area to attain said predetermined level; wherein said input includes an intensity of a dimmable lamp to be turned on and at least one of a number of lamps to be turned on, a number of lamps to be turned off, a location of a lamp to be turned on and a location of a lamp to be turned off.

2. A method as claimed in claim 1, further comprising generating said artificial lighting input in said building area using said at least one lamp and said at least one additional lamp.

3. A method as claimed in claim 2, further comprising repeating said steps of obtaining, comparing and calculating to adjust said calculated artificial lighting input in response to a modified ambient light intensity level caused by said generating said artificial lighting input.

4. A method as claimed in claim 2, wherein at least one of said lamp and said additional lamp is grouped in at least one group of lamps and said generating comprises turning on at least one of said group of lamps.

5. A method as claimed in claim 2, wherein said artificial lighting input is generated using a control of the range of intensity provided by each lamp in said building area.

6. A method as claimed in claim 1, wherein said obtaining comprises placing at least one light intensity sensor and determining a light intensity level for said area.

7. A method as claimed in claim 6, wherein said placing comprises placing a plurality of sensors in said area and determining said ambient light intensity level by averaging a light intensity reading of said sensors to obtain an averaged ambient light intensity level.

8. A method as claimed in claim 1, wherein said calculating comprises verifying if a total energy spent by said artificial lighting input is close to a predetermined total energy spent limit, and if said total energy spent is close, adjusting a command for said artificial lighting input using load shedding to maintain said total energy spent below said total energy spent limit.

9. A system for maintaining an ambient light intensity in a building area at a predetermined level, comprising:

an input for providing a predetermined level of light intensity for said building area;

at least one light level sensor to obtain an ambient light intensity level for said building area, said ambient light intensity level being a combination of a natural light level and an artificial light level;

a light intensity verifier for comparing said ambient level to said predetermined level of light intensity;

a light intensity controller for calculating an artificial lighting input to be generated in said building area to attain said predetermined level, if said ambient level differs from said predetermined level, wherein said input includes an intensity of a dimmable lamp to be turned on and at least one of a number of lamps to be turned on, a number of lamps to be turned off, a location of a lamp to be turned on and a location of a lamp to be turned off;

at least one artificial lamp in said building area to generate said artificial lighting input in said building area, wherein at least one of said at least one lamp is a dimmable lamp;

at least one additional artificial lamp in said building area to generate said artificial lighting input in said building area, wherein each said at least one lamp is one of a dimmable lamp and a lamp not capable of being dimmed.

10. A system as claimed in claim 9, wherein said at least one light level sensor is three light level sensors.

11. A system as claimed in claim 10, wherein said light intensity verifier averages a light intensity reading from said sensors prior to comparing.

12. A system as claimed in claim 9, wherein said light intensity level is measured in Lux.

13. A system as claimed in claim 9, further comprises a load shedder for verifying if a total energy spent by said artificial lighting input is close to a predetermined total energy spent limit, and if said total energy spent is close, adjusting a command for said artificial lighting input using load shedding to maintain said total energy spent below said total energy spent limit.

14. A system as claimed in claim 13, wherein a set point for said lamp is offset with a value calculated by OffsetSP=K*PB, where K is a multiplication factor and PB is a predetermined proportional band parameter.

* * * * *